US005625252A

United States Patent [19]

Tsuzurahara et al.

[11] Patent Number: 5,625,252

[45] Date of Patent: Apr. 29, 1997

[54] MAIN LENS STRUCTURE FOR A COLOR CATHODE RAY TUBE

[75] Inventors: Mamoru Tsuzurahara; Shoji Shirai, both of Mobara, Japan

[73] Assignee: Hitachi, Ltd., Tokyo, Japan

[21] Appl. No.: 395,465

[22] Filed: Feb. 28, 1995

[30] Foreign Application Priority Data

Mar. 1, 1994 [JP] Japan ..... 6-031478

[51] Int. Cl.[6] ..... H01J 29/50

[52] U.S. Cl. ..... 313/414; 313/449; 313/460

[58] Field of Search ..... 313/409, 412, 313/414, 458, 449, 460; 315/8

[56] References Cited

U.S. PATENT DOCUMENTS

| | | | |
|---|---|---|---|
| 5,013,963 | 5/1991 | Ikegami et al. | 313/414 |
| 5,146,133 | 9/1992 | Shirai et al. | 313/414 |
| 5,212,423 | 5/1993 | Noguchi et al. | 313/414 |
| 5,300,854 | 4/1994 | Kweon | 313/414 |
| 5,367,221 | 11/1994 | Santy et al. | 315/8 |
| 5,414,323 | 5/1995 | Uchida et al. | 313/414 |
| 5,461,278 | 10/1995 | Misono et al. | 313/414 |

FOREIGN PATENT DOCUMENTS

| | | | |
|---|---|---|---|
| 0284990A2 | 10/1988 | European Pat. Off. | H01J 29/50 |
| 49-5591 | 2/1974 | Japan | H01J 29/50 |
| 55-104187 | 8/1980 | Japan | H04N 9/29 |
| 58-123288 | 7/1983 | Japan | H09N 9/29 |
| 2-78388 | 3/1990 | Japan | H04N 9/29 |
| 2-18540 | 4/1990 | Japan | H01J 29/50 |
| 3-232387 | 10/1991 | Japan | H04N 9/29 |
| 4-44379 | 7/1992 | Japan | H01J 29/50 |

*Primary Examiner*—Michael Horabik
*Assistant Examiner*—Michael Day
*Attorney, Agent, or Firm*—Antonelli, Terry, Stout & Kraus, LLP

[57] ABSTRACT

A color cathode ray tube equipped with an electron gun having a main lens with a large equivalent aperture by suppressing spherical aberration and astigmatism of the main lens sufficiently. The main lens for converging the three electron beams, which are arranged generally in parallel in one direction toward the fluorescent face, upon the fluorescent face, includes two electrodes arranged to confront each other with such flattened apertures that the diameter H taken in the one direction is larger than a diameter V taken perpendicularly to the one direction. The orbits of the two side ones of the three electron beams passing through the main lens have a constant gap S from the orbit of the center electron beam. The relations of H=2(S+R) and R>S hold, if the distance between the orbits of the two side electron beams and the inner circumference, as taken in the one direction, of the electrodes constituting the main lens is designated at R.

9 Claims, 13 Drawing Sheets

MAIN LENS STRUCTURE FOR A COLOR CATHODE RAY TUBE

BACKGROUND OF THE INVENTION

The present invention relates to a color cathode ray tube and, more particularly, to a color cathode ray tube equipped with an in-line type electron gun which is its focusing characteristics drastically improved by enlarging the equivalent aperture.

The color cathode ray tube, which is much used as a display device in TV receivers and terminals of information devices, still requires drastic improvement in its focusing characteristics in order to provide higher precision and improved quality of display images.

The factors which exert serious influences upon the focusing characteristics of color cathode ray tube are exemplified by the magnifications and aberrations of the main lens of the electron gun of the color cathode ray tube.

In a color cathode ray tube, the distance from the main lens to the focal plane (or fluorescent face) is determined when the scanning area and the maximum deflection angle of the electron beam are determined. The lens magnification is reduced if the lens converging action is as, for example, by enlarging the diameter of the aperture of the electrodes constituting the main lens as much as possible, under the condition that the distance to the focal plane is constant. Further the angle of the incidence of electron beam upon the main lens is reduced if the divergence of the electron beam in the main lens is suppressed within a predetermined value so as to prevent an increase in deflection errors.

If the electron beam incidence angle is designated at $\alpha i$, the minimum disturbance circle diameter $\delta$ of the electron beam by the most dominant spherical one of the aberrations of the main lens is expressed by the following equation:

$$\delta=(1/2)M\cdot Csp\cdot\alpha i^3,$$

wherein:

M: lens magnification; and

Csp: coefficient of spherical aberration.

Thus in the electron gun of the cathode ray tube, the lens magnification and the spherical aberration are reduced to improve the focusing characteristics if the converging action of the main lens is weakened.

One method of weakening the converging action of the main lens is to enlarge the diameter of the aperture of the electrodes constituting the main lens as much as possible.

However, the enlargement of the diameter of the aperture of the main lens constituting electrodes thickens the neck portion accommodating the electron gun so that the deflection yoke to be used is necessarily enlarged, causing an increase in the deflecting electric power.

FIG. 18 is a schematic section for explaining the construction of an electron gun used in the color cathode ray tube of the prior art, which has been proposed to enlarge the diameter of the aperture of the main lens constituting electrodes with respect to the diameter of the restricted neck portion. Reference numeral 10 designates cathodes; numeral 11 a first grid electrode (i.e., G1 electrode); numeral 12 a second grid electrode (i.e., G2 electrode); numeral 13 a third grid electrode (i.e., G3 electrode); numeral 14 a fourth grid electrode (i.e., G4 electrode); numeral 15 a fifth grid electrode (i.e., G5 electrode); numeral 16 a sixth grid electrode (i.e., G6 electrode); numeral 17 a shield cup; numeral 15' an internal electrode of the fifth grid electrode; numeral 16' an internal electrode of the sixth grid electrode 16; reference D5 an amount of regression or recessing of the internal electrode 15' with respect to the face of the G5 electrode 15 opposing the G6 electrode 16; and reference D6 an amount of regression or recessing of the internal electrode 16' with respect to the face of the G6 electrode 16 opposing the G5 electrode 15.

In the in-line type electron gun having three electron beams BR, BG and BB arrayed horizontally with a gap S, as shown in FIG. 18, the electrodes constituting the main lens are arranged such that they confront the two cylindrical electrodes (i.e., the fifth grid electrode 15 and the sixth grid electrode 16) having a flattened single aperture with its longer axis in the (in-line) direction in which the three electron beams BR, BG and BB are arrayed.

FIGS. 19(*a*) and 19(*b*) are front elevations taken in the fifth grid electrode direction along the M—M line of FIG. 18. FIG. 19(*a*) is an explanatory view of the main lens aperture in the case of a large S dimension (i.e., the distance between the electron beam orbits taken in one direction or the in-line array direction, that is, the distance between the center electron beam BG and the side electron beams BR and BB), and FIG. 19(*b*) is an explanatory view in the case of a small S dimension as compared with the case of FIG. 19(*a*).

Incidentally, in a front elevation of the sixth grid electrode, as taken along line N—N of FIG. 18, the reference numeral 15 in FIGS. 19(*a*) and 19(*b*) is replaced by numeral 16.

Here, in the example of FIG. 18, as shown in FIGS. 19(*a*) and 19(*b*), the flattened shape of the aperture of the aforementioned fifth grid electrode 15 and sixth grid electrode 16 (although not shown in FIGS. 19(*a*) and 19(*b*)) is not circular but is formed by joining two semicircular arcs by two parallel straight lines. However, the aperture should not be limited thereto if it is flattened to have its longer axis in the in-line direction.

Since such non-circular main lens has a larger diameter in the horizontal direction than in the vertical direction, the invasion of the electric field is more in the horizontal direction so that the effective diameter is larger in the horizontal direction than in the vertical direction. As a result, the lens converging action is strengthened in the vertical direction so that an astigmatism will appear when the electron beams are to be converged. Incidentally, this prior art is disclosed in Japanese Patent Publication No. 18540/1990.

As shown in FIGS. 19(*a*) and 19(*b*), therefore, the astigmatism is corrected by the internal electrodes 15' and 16' which are disposed in the cylindrical electrodes (i.e., the fifth grid electrode and the sixth grid electrode) 15 and 16 for allowing the three electron beams to pass therethrough and which are formed with elliptical apertures $\mathbf{15}_2$ and $\mathbf{16}_2$ (although the latter $\mathbf{16}_2$ is not shown) having their longer axes in the vertical direction (perpendicular to the aforementioned one direction).

An effectively large aperture lens is formed while suppressing the aforementioned spherical aberration and astigmatism, by adjusting the shape and dimension of the elliptical apertures and the mounting positions (i.e., the amounts of regression or recessing from the confronting faces of the two electrodes) of those internal electrodes 15' and 16', as shown in FIG. 18.

Moreover, spherical aberration and astigmatism can be suppressed by adjusting the positions of the internal electrodes which are mounted in the two electrodes constituting the main lens, and the three electron beams BR, BG and BB can be directed to converge on the fluorescent face by deflecting the side electron beams BR and BB toward the center electron beam BG.

A color cathode ray tube having an electron gun of this kind is disclosed in the aforementioned Publication and Japanese Patent Publication No. 44379/1992, for example.

With the construction described above, the shorter gap (i.e., the S dimension) of the three electron beams is the more convenient for achieving a larger aperture lens in the in-line electron gun.

Here will be examined the correspondence between the S-dimension in the main lens portion of the electron gun and the aperture shapes of the cylindrical electrodes 15 and 16 with reference to FIGS. 19(*a*) and 19(*b*) (as taken in section M—M of FIG. 18). The horizontal aperture dimension H can be expressed, as follows:

$$H=2(R+S).$$

Here, if the aperture dimension V in the vertical direction is substantially equalized to 2R and if the positions and shapes of the internal electrodes 15' and 16' are adjusted, the effective lens apertures for the center and two side electron beams can be equalized substantially to 2R in the vertical and horizontal directions.

If an in-line type electron gun having the aforementioned construction and which is used in a color cathode ray tube having a nominal frame size of 14 to 25 inches, for example, and a neck external diameter of 29 mm is to be accommodated in the cathode ray tube having the neck external diameter of 29 mm, the aforementioned H dimension is limited to about 19 mm including the thickness of the electrodes and the gap from the neck internal wall.

With an equal neck diameter, that is, with an equal horizontal aperture dimension H, as apparent from the comparison between FIG. 19(*a*) and 19(*b*), the aperture diameter "2R" of the main lens for the center and two side electron beams becomes more for the smaller S dimension, as shown in FIG. 19(*b*), than for the larger S dimension, as shown in FIG. 19(*a*). As a result, the construction of FIG. 19(*a*) has a greater spherical aberration and astigmatism of the main lens than the construction of FIG. 19(*b*) so that its focusing characteristics are worse.

This means that the S dimension is desirably set to a smaller value so as to provide an electron gun having excellent focusing characteristics. Despite this desire, however, with the smaller S dimension, the two side ones of the three electron beams are reduced in their incidence angle upon the shadow mask, as described above. This further means that the distance (which will be called "Q") between the shadow mask and the fluorescent face has to be enlarged.

The space between the electron guns and the shadow mask is shielded from the influence of the earth magnetism by a shadow mask and the magnetic shield. With a large Q dimension, however, the section in which the electron beams are influenced by the earth magnetism is elongated. As a result, even if the color cathode ray tube is directed in one direction and adjusted to cause the electron beams to land on the correct position, the electron beams are moved by the influence of earth magnetism, when the color cathode ray tube is directed in another direction, so that the electron beams fail to land on the correct position, thereby to deteriorate the color purity of the color cathode ray tube.

In the invention disclosed in Japanese Patent Laid-Open No. 123288/1983 or 232387/1991, the means for correcting the aforementioned influence of the earth magnetism is exemplified by a correction coil disposed around the panel portion of the color cathode ray tube for bucking the external magnetism (i.e., the horizontal component of the earth magnetism) in the axial direction, thereby to suppress the purity deterioration.

In Japanese Patent Laid-Open No. 104187/1980 or 78388/1990, on the other hand, there is disclosed a color cathode ray tube which is equipped with a correction coil for bucking the vertical component of the earth magnetism.

In the case of the prior art cathode ray tube having a neck external diameter of 29 mm, an electron gun of the type having a cylindrical lens of a diameter of about 5.5 mm, for allowing the three electron beams to pass therethrough in the main lens portion, has an S dimension of 6.6 mm. This S dimension is narrowed to 5.5 mm in the electron gun of the aforementioned type disclosed in Japanese Patent Publication No. 18540/1990 or 44379/1992.

FIG. 20 is an explanatory diagram of a relation between the S dimension and the purity and plots, which diagram electron beam landing degree (μm) against the S dimension (mm).

FIG. 20 plots the relation between the electron beam landing degree and the S dimension, which was experimentally obtained at the central portion of the display when a highly fine color cathode ray tube (the shadow mask of which had a pitch of 0.28 mm) having an effective display diagonal dimension of 36 cm and a deflection angle of 90 degrees for an information processing terminal was turned in the east-west direction to the north-south direction.

Incidentally, the electron beam landing degree indicates the distance from the end portion of the fluorescent element of another color to the end portion of the electron beam when the electron beam center is shifted from the center of the fluorescent element for the electron beam to land by the aforementioned turn so that it approaches the adjoining fluorescent element of another color.

Since this electron beam landing degree is smaller in the peripheral portion than at the central portion of the display, the purity is liable to deteriorate if the electron beam landing degree becomes lower than 7 μm.

It is found from FIG. 20 that the S dimension of about 4.8 mm is required for retaining the electron beam landing degree at 7 μm or higher, while considering the production deviation, so as to prevent the deterioration of the purity in the aforementioned peripheral portion of the display.

As a result, if the value of the aforementioned dimension H is at about 19 mm, the distance R from the center of the side electron beam to the inner wall of the electrode will be about 4.7 mm, and the enlargement of the distance R will be limited to about R≈S.

The value (i.e., the R dimension) of the distance R indicates the shortest distance from the center of the side electron beam to the inner wall of the electrode and accordingly gives the effective radius of the main lens of the electron gun in the outward direction with respect to the side electron beam.

In the main lens of the aforementioned electron gun disclosed in Japanese Patent Publication No. 18540/1990, the elliptical aperture shapes and mounted positions (i.e., the positions of regression or recessing from the two confronting electrodes, as indicated by the dimensions D5 and D6 in FIG. 18) of the internal electrodes 15' and 16' disposed in the electrodes are optimized to equalize the main lens aperture effectively to about twice that of the aforementioned R dimension in all directions for the center and side electron beams, thereby to balance the focusing characteristics.

If the balance of these focusing characteristics collapses in one direction, the electron beam fails to be focused in that direction. Therefore, the focusing characteristics can be improved by enlarging the R dimension and accordingly the main lens aperture, thereby to reduce the spherical aberration. In the prior art described above, however, the R dimension is restricted within the S dimension.

Incidentally, Japanese Patent Publication No. 5591/1974 discloses an electron gun for a color cathode ray tube, which is given a large aperture lens by causing the three electron beams to intersect in the single cylindrical type main lens portion.

FIG. 21 is a schematic section for explaining a schematic structure of an electron gun for a color cathode ray tube of the prior art, which is given a large aperture lens by causing the three electron beams to intersect in the single cylindrical type main lens portion. The same reference numerals as those of FIG. 18 correspond to identical portions in FIG. 21. Numeral 20 designates deflection means, and letters BR, BG and BB designate the electron beams which land on the red, green and blue fluorescent elements, respectively.

In an electron gun of this type, as apparent from FIG. 21, the S dimension of the main lens portion is minimized because the three electron beams BR, EG and BB are made to intersect in the main lens. Downstream of the main lens portion, the two side electron beams BR and BB have to be diverged again to such an S dimension in the position of the deflection means 20 for converging the two side electron beams in such a way as to cause no deterioration of the aforementioned purity.

For this purpose, the electrode (i.e., the fifth grid electrode 15) to be supplied with a high voltage, which has a space for gradually enlarging the gap between the two side electron beams BR and BB and which constitutes the main lens, has to be axially elongated to a predetermined value or more. Thus, there arises a defect that the electron gun has its overall length increased.

SUMMARY OF THE INVENTION

The present invention has been conceived in view of the background thus far described and has an object to provide a color cathode ray tube which is equipped with an electron gun having a main lens of large equivalent aperture by sufficiently suppressing the spherical aberration and astigmatism of the main lens.

Another object of the present invention is to provide a color cathode ray tube which is equipped with an electron gun having its focusing characteristics further improved without inviting the deterioration of the purity characteristics or enlarging its overall length.

In order to achieve the above-specified objects, according to a feature of the present invention, the color cathode ray tube having the aforementioned construction is equipped with correction means for making the aforementioned S dimension smaller than the R dimension to maximize the aperture of the main lens of the electron gun and for reducing the S dimension, if necessary, to increase the Q dimension to suppress the accompanying deterioration of the purity.

In a color cathode ray tube having the aforementioned construction, according to another feature of the present invention, the two side ones of the three electron beams in the electron gun have their orbits adjusted to minimize the S dimension in the main lens and are corrected in the direction to enlarge the S dimension, when they leave the main lens, and deflection means is disposed at the end portion of the electron gun to converge the two side electron beams, thereby to enlarge the angle of incidence of the two side electron beams upon the shadow mask.

Specifically, according to a first feature of the invention, there is provided a color cathode ray tube comprising an electron gun including electron beam emitting means for emitting three electron beams, including one center electron beam and two side electron beams, generally in parallel in one direction toward a fluorescent face; and a main lens for converging the three electron beams upon the fluorescent face, wherein the main lens of the electron gun includes two electrodes arranged to confront each other with such flattened apertures that the diameter H taken in the one direction is larger than a diameter V taken perpendicularly to the one direction, wherein the orbits of the two side ones of the three electron beams passing through the main lens have a constant gap S from the orbit of the center electron beam, and wherein the relations of $H=2(S+R)$ and $R>S$ hold, if the distance between the orbits of the two side electron beams and the inner circumference, as taken in the one direction, of the electrodes constituting the main lens is designated as R.

In the first feature of the invention, according to a second feature the relation of $V>2R$ holds between the diameter V of the electrodes constituting the main lens, as taken perpendicularly to the one direction, and a distance R from the side electron beam orbits to the inner circumference, as taken in the one direction, of the electrodes constituting the main lens.

In the first feature of the invention, according to a third feature the relations of $2R+0.2\text{ mm}>V>2R-0.2\text{ mm}$ hold between the diameter V of the electrodes constituting the main lens, as taken perpendicularly to the one direction, and a distance R from the side electron beam orbits to the inner circumference, as taken in the one direction, of the electrodes constituting the main lens.

According to a fourth feature of the invention, there is provided a color cathode ray tube comprising an electron gun including electron beam emitting means for emitting three electron beams generally in parallel in one direction toward a fluorescent face; and a main lens for converging the three electron beams upon the fluorescent face, wherein the main lens of the electron gun includes two electrodes arranged to confront each other with such flattened apertures that the diameter taken in the one direction is larger than a diameter V taken perpendicularly to the one direction, and wherein the orbits of the two side ones of the three electron beams passing through the main lens have a constant gap S from the orbit of the center electron beam, further comprising deflection means interposed between the main lens and the fluorescent face for condensing the two side electron beams and the center electron beam upon the fluorescent face.

According to a fifth feature of the invention, there is provided a color cathode ray tube comprising an electron gun including electron beam emitting means for emitting three electron beams generally in parallel in one direction toward a fluorescent face; and a main lens for converging the three electron beams upon the fluorescent face, wherein the main lens of the electron gun includes two electrodes arranged to confront each other with such flattened apertures that the diameter taken in the one direction is larger than a diameter V taken perpendicularly to the one direction, and wherein the orbits of the two side ones of the three electron beams passing through the main lens have a constant gap S from the orbit of the center electron beam and are arranged such that they are directed in parallel or diverging directions toward the fluorescent face with respect to the center electron beam orbit, further comprising deflection means interposed between the main lens and the fluorescent face for condensing the two side electron beams and the center electron beam upon the fluorescent face.

In the first to fifth features, according to a sixth feature, the color cathode ray tube further comprises an internal electrode disposed in either or both of the two electrodes constituting the main lens of the electron gun, and formed with an aperture having such a dimensional relation for allowing the center electron beam to pass therethrough that the diameter in the one direction is smaller than the diameter perpendicular to the one direction.

Incidentally, the following constructions (1) to (6) may be added to the foregoing first to fifth features: (1) The color cathode ray tube further comprises an internal electrode disposed in either or both of the two electrodes constituting the main lens of the electron gun, and formed with an aperture having such a dimensional relation for allowing the center electron beam to pass therethrough that the diameter in the one direction is smaller than the diameter perpendicular to the one direction, wherein the regression dimensions of the internal electrodes from the aperture ends of the two electrodes constituting the main lens are made larger at the side of that one of the two electrodes as is supplied with a high voltage. (2) The color cathode ray tube further comprises an internal electrode disposed in either or both of the two electrodes constituting the main lens of the electron gun, and formed with an aperture having such a dimensional relation for allowing the center electron beam to pass therethrough that the diameter in the one direction is smaller than the diameter perpendicular to the one direction, wherein the aperture diameter, as taken in a direction perpendicular to the one direction, of the internal electrode to be disposed in that one of the two electrodes constituting the main lens as confronts the electrode to be supplied with a high voltage is made smaller than the aperture diameter, as taken in the direction perpendicular to the one direction, of the internal electrode disposed in the electrode to be supplied with the high voltage. (3) The diameter, as taken perpendicularly to the one direction, of the aperture end of that one of the two electrodes constituting the main lens of the electron gun as confronts the electrode to be supplied with the high voltage is made larger than the aperture diameter, as taken perpendicular to the one direction, of the electrode to be supplied with the high voltage. (4) In that one of the two electrodes constituting the main lens of the electron gun which confronts the electrode to be supplied with the high voltage, there is disposed a correction electrode which has faces arranged in parallel with the one direction to interpose the individual electron beams, or the two side electron beams or the center electron beam. (5) In that one of the two electrodes constituting the main lens of the electron gun which confronts the electrode to be supplied with the high voltage, there is disposed a correction electrode which has faces normal to the one direction to interpose the individual electron beams. (6) The gap, as viewed in a direction perpendicular to the one direction, which is formed by the aperture end portions of the two electrodes constituting the main lens of the electron gun, is inclined toward the cathodes at the two sides.

In the fourth or fifth feature of the invention, according to a seventh feature, the deflection means to be disposed between the main lens of the electron gun and the fluorescent face employs electrostatic deflection.

In the seventh feature of the invention, according to an eighth feature, the deflection means includes a rectangular electrode which is formed into a rectangular section having a longer axis perpendicular to the one direction for allowing the center electron beam to pass therethrough, and which is supplied with an anode voltage; and a pair of parallel flat electrodes enclosing the rectangular electrodes and supplied with a voltage which is slightly lower than the anode voltage so as to allow the two side electron beams to pass therethrough.

Moreover, the following constructions (7) to (9) may be added to the above-specified eighth feature of the invention: (7) The paired parallel flat electrodes have base portions for connecting the end portions perpendicular to the one direction, and are fixed on the bed portions after only the base portions have been fixed on the beading glasses together with the rectangular electrodes and the individual electrodes constituting the electron gun and including the electrodes constituting the main lens. (8) The rectangular electrodes have their axial lengths made shorter away from the main lens than the flat electrodes at the side of the main lens. (9) An anode voltage is divided by a voltage dividing resistor made of a highly resistive material as a means for applying a voltage slightly lower than the anode voltage to the parallel flat electrodes of the deflection means.

In the first to fifth features of the invention, according to a ninth feature, the color cathode ray tube further comprises a correction coil for establishing a magnetic field to buck the external magnetic field to act upon the electron beams.

According to the electron gun of the color cathode ray tube thus constructed, the S dimension in the main lens can be substantially reduced with the common neck diameter, i.e., the common H dimension, so that the main lens aperture at the outer portions of the side beams can be made larger than that of the case in which the S dimension is large. As a result, the main lens aperture can be enlarged in the individual directions of the center and side beams in accordance with that aperture so that the spherical aberration can be suppressed to improve the focusing characteristics.

When, moreover, it is necessary to suppress the deterioration of the purity due to an increase caused in the Q dimension caused by decreasing the S dimension, the electron beams emanating from the shadow mask are allowed to run straight without having their orbits deflected, by the correction coil acting as a correction means for establishing a magnetic field to buck the external magnetism, such as the earth magnetism, so that the aforementioned Q dimension can be enlarged. As a result, the S dimension in the main lens can be substantially reduced so that the main lens aperture of the outer portions of the side electron beams can be made larger than that of the case of a larger S dimension.

As a result, the main lens aperture in all directions of the center and side electron beams can be accordingly enlarged to suppress the spherical aberration and improve the focusing characteristics.

Another means for suppressing the purity deterioration is exemplified by deflection means interposed between the main lens and the fluorescent face for converging the two side electron beams and the center electron beam upon the fluorescent face. As a result, the angle of incidence of the two side electron beams upon the shadow mask can be enlarged to avoid the problem of purity deterioration. Since, at this time, the S dimension in the main lens portion is set to a predetermined value or more to avoid the concentration of the three electron beams at one point in the main lens portion, the S dimension in the position of the deflection means can be enlarged to cause no purity deterioration without increasing the gap between the main lens portion and the deflection means. Thus, it is possible to avoid the defect of an increase in the overall length of the electron gun.

Specifically, the orbits of the two side ones of the aforementioned three electron beams run with a gap with the center electron beam through the main lens of the electron gun, which is composed of at least two electrodes arranged to confront each other with flattened apertures, in which the diameters taken in the one direction are larger than those taken perpendicularly to the one direction. This gap, i.e., the S dimension, is smaller than the S dimension of the color cathode ray tube of the prior art.

Thus, the three electron beams pass through the central portion of the main lens so that this main lens acts as a lens having a large equivalent aperture for the three electron beams.

Moreover, the increase in the Q dimension, i.e., the distance between the shadow mask and the fluorescent layer can be prevented by interposing deflection means between the main lens and the fluorescent face for converging the two side electron beams and the center electron beam upon the fluorescent face.

Moreover, the orbits of the two side ones of the three electron beams run with a gap from the orbit of the center electron beam and in parallel or divergently toward the fluorescent face through the main lens of the electron gun, which is composed of at least two electrodes arranged to confront each other with the flattened aperture having the larger one-directional diameter than the perpendicular diameter.

The deflection means interposed between the main lens and the fluorescent face deflects the two side ones of the three electron beams having passed through the main lens, in a direction apart from the center beam and then in a direction to converge upon the fluorescent layer. This deflection avoids the increase in the Q dimension.

DESCRIPTION OF THE PREFERRED EMBODIMENTS

The present invention will be described in detail in connection with various embodiments with reference to the accompanying drawings.

Figure 1:
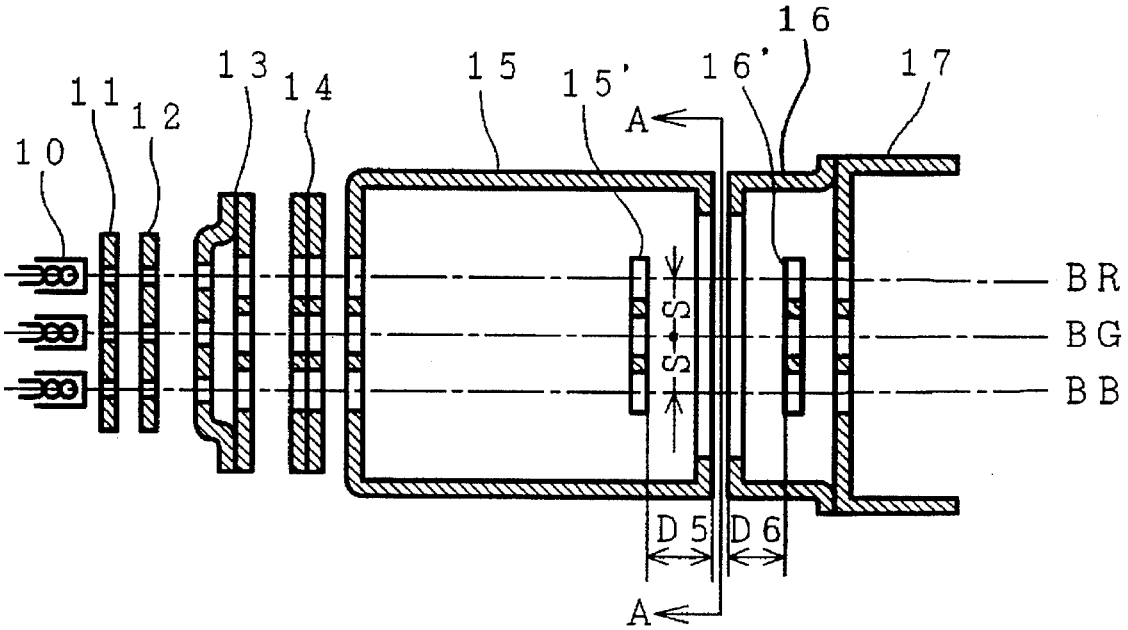
FIG. 1 is a schematic section for explaining a construction of an electron gun to be used in a first embodiment of a color cathode ray tube according to the present invention.

FIG. 1 is a schematic section for explaining a construction of an electron gun to be used in an embodiment of the color cathode ray tube according to the present invention. Reference numeral 10 designates cathodes which are individually equipped therein with heaters for heating their thermoelectron emitting surface substances to emit three electron beams BR, BG and BB. Numerals 11 to 16 designate first to sixth grid electrodes (i.e., G1 to G6 electrodes); numeral 15' designates an internal electrode of the fifth grid electrode; numeral 16' designates an internal electrode of the sixth grid electrode; and numeral 17 designates a shield cup.

In FIG. 1, the cathode 10, the first grid electrode 11 and the second grid electrode 12 constitute together a so-called "triple-pole unit" for producing electrons to establish the electron beams; and the third grid electrode 13, the fourth grid electrode 14, the fifth grid electrode 15 and the sixth grid electrode 16 constitute together a U-BPF (Uni-bi-Potential-Focusing) type multistage lens.

As drive voltages: a voltage of 400 to 1,000 V (volts) is applied by connecting the second grid electrode 12 and the fourth grid electrode 14; a voltage (i.e., a focusing voltage) of 5 to 10 KV is applied by connecting the third grid electrode 13 and the fifth grid electrode 15; and a voltage (i.e., an anode voltage) of about 20 to 35 KV is applied to the sixth grid electrode 16. Incidentally, the shield cup 17 is provided for shielding the electric field noise from the outside.

Figure 2:
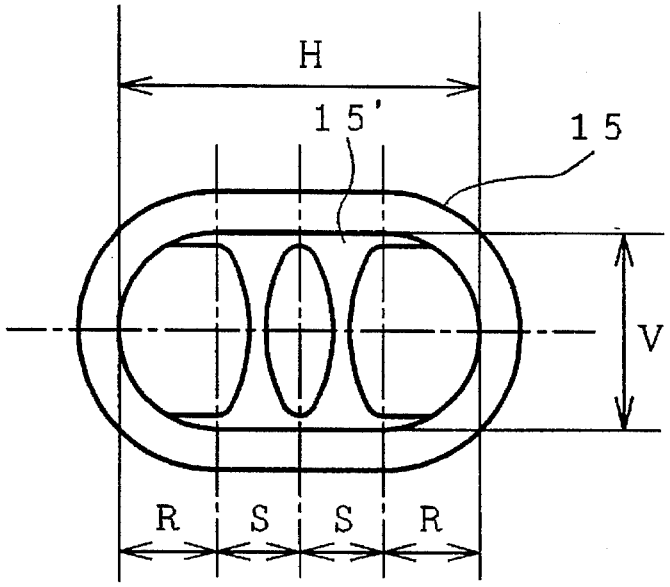
FIG. 2 is a front elevation of a fifth grid electrode, as taken from the direction of arrows A—A of FIG. 1.

Moreover, FIG. 2 is a front elevation of the fifth grid electrode, as taken in the direction of arrows A—A of FIG. 1, and the same reference numerals as those of FIG. 1 correspond to the identical portions.

In the electron gun having the illustrated construction, there is formed between the fifth grid electrode 15 and the sixth grid electrode 16 a main lens, in which the dimension S is set as small as possible within such a range that the center electron beam BG and the two side electron beams BR and BB do not interfere with each other.

Specifically, as to the aperture dimension of the main lens shown in FIG. 2, the distance R between the two side electron beams BR and BB and the inner circumference of the fifth grid electrode 15, having a diameter H, as taken along the (in-line) direction in which the three electron beams are arrayed, has a relation of H=2(S+R), wherein R>S.

Here will be described an example of the case in which the fifth grid electrode 15 and the sixth grid electrode 16, as shown in FIG. 1, are respectively equipped therein with the internal electrodes 15' and 16'.

Figure 3:
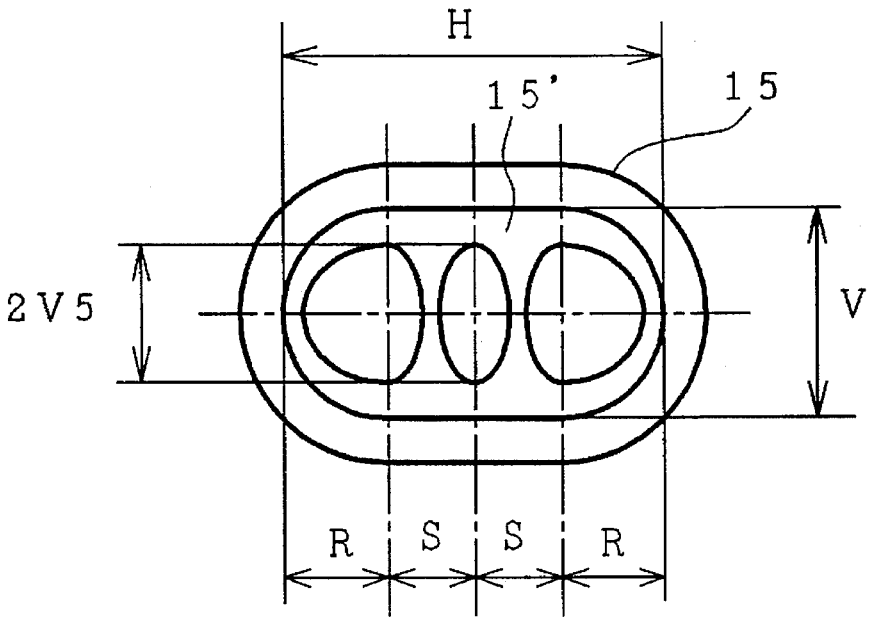
FIG. 3 is a front elevation of a fifth grid electrode, as in FIG. 2, for explaining a construction of an electron gun to be used in the color cathode ray tube according to the present invention.

FIG. 3 is a front elevation of another form of the fifth grid electrode, similar to FIG. 2, for explaining the construction of an electron gun to be used in a color cathode ray tube according to the present invention. The same reference numerals as those in the Figures for describing the foregoing embodiment correspond to the identical portions in FIG. 3.

In FIG. 3 the dimension, as taken in the in-line (or horizontal) direction, of the aperture of the fifth grid electrode 15 constituting the main lens is designated at H; the size in the perpendicular (or vertical) direction is designated at V; and the dimension of the aperture of the internal electrode 15' in the vertical direction is designated at 2VS. If a relation of V>2V5 holds, the invasion of the potential in a direction perpendicular to the in-line direction is suppressed to make the main lens aperture of the center and side electron beams in the vertical direction smaller than the dimension V.

In order to retain a balance with the aperture of 2R of the side electron beams outwards in the horizontal direction; therefore, the dimension is set to V>2R.

Figure 18:
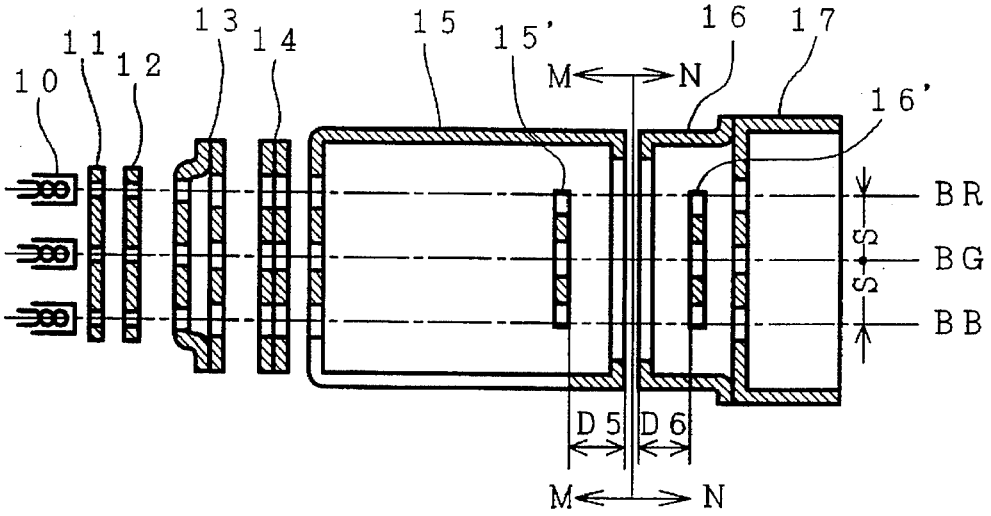
FIG. 18 PRIOR ART
FIG. 18 is a schematic section for explaining the construction of an electron gun used in the color cathode ray tube of the prior art, in which it has been proposed to make the diameter of the aperture of an electrode constituting the main lens larger than that of a constricted neck portion.

As a result, even with the common H dimension, the main lens to be obtained can have a far larger aperture than that of the electron gun of the construction of the prior art having the relation of R<S, as has been described with reference to FIG. 18.

Figure 4:
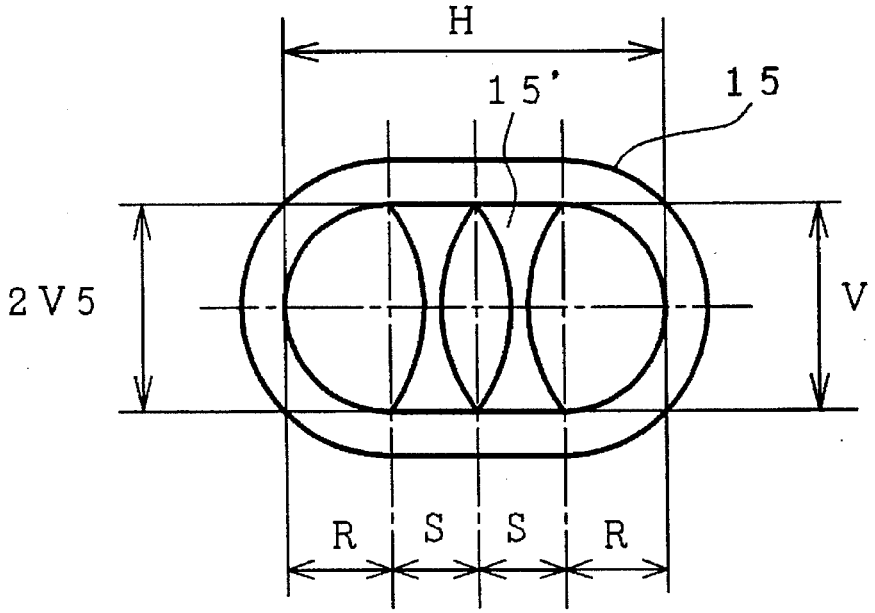
FIG. 4 is a front elevation of a fifth grid electrode, as in FIG. 2, for explaining a construction of an electron gun to be used in the color cathode ray tube according to the present invention.

FIG. 4 is a front elevation of another form of the fifth grid electrode, similar to FIG. 2, for explaining the construction of an electron gun to be used in a color cathode ray tube according to the present invention. The same reference numerals as those in the Figures for describing the foregoing embodiment correspond to the identical portions in FIG. 4.

In FIG. 4, if the vertical dimension V of the aperture of the fifth grid electrode 15 constituting the main lens and the dimension 2V5 of the aperture of the internal electrode 15' in the common direction are in a relation of V≈2V5, the invasion of the potential into the internal electrode 15' in the vertical direction of the center and side electron beams is not suppressed so that the equivalent aperture of the main lens is not reduced, but is substantially equalized to the V dimension.

Since, on the other hand, the equivalent aperture of the side electron beams outwards in the horizontal direction is substantially at 2R, the aperture is balanced in the individual directions if V≈2R. If, in this case, the dimension is set to 2R+0.2 mm>V>2R−0.2 mm, it is possible, as will be described in the following, to prevent the deterioration of the focusing characteristics due to the focusing voltage difference between the center electron beam and the side electron beams.

Here, a change in the R dimension leads to a change in the aperture of the main lens and depends especially upon the apertures of the lenses to be passed by the two side electron beams BR and BB.

Figure 5:
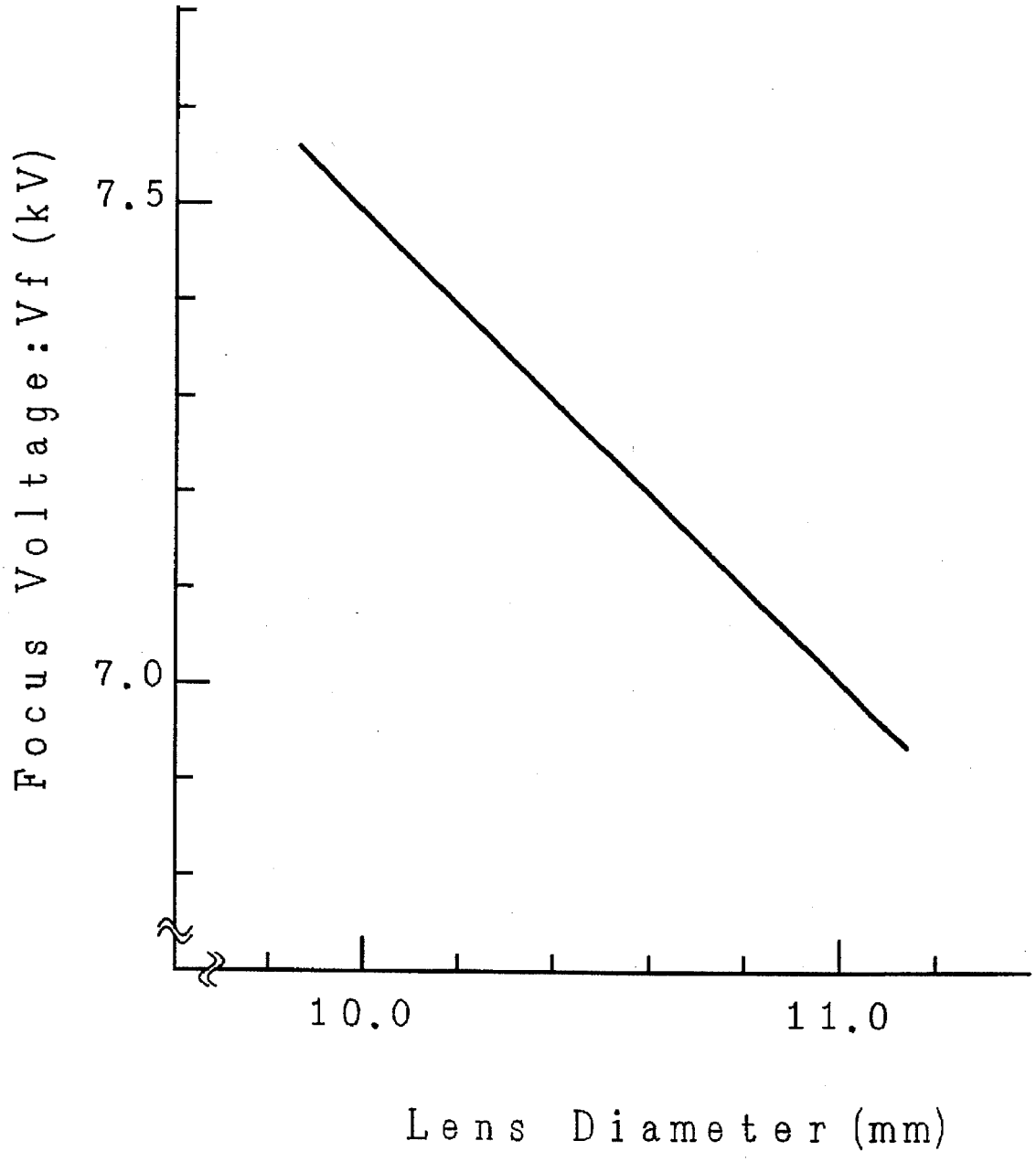
FIG. 5 is a diagram for explaining a relation between a focusing voltage and a lens aperture, as determined by the simulation of an electron beam orbit.

FIG. 5 is an explanatory diagram plotting a relation between a focusing voltage, as determined by the simulation of an electron beam orbit, and the lens aperture. The abscissa indicates the aperture (mm) of the lens, and the ordinate indicates the focusing voltage Vf (KV).

As plotted, the focusing voltage Vf changes by about 50 V (volts) for 0.1 mm of the lens aperture. It is therefore found that, within the fluctuation range of the aforementioned V dimension, the difference in the focusing voltage between the two side electron beams BR and BB and the center electron beam BG is confined within the range of ±100 V.

Figure 6:
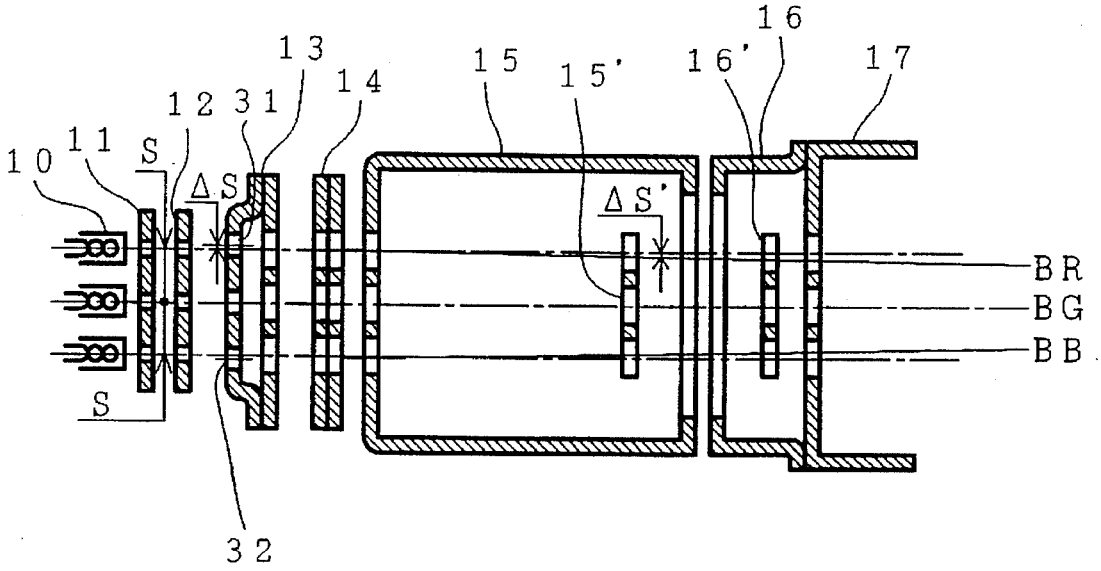
FIG. 6 is a schematic section for explaining a construction of an electron gun to be used in an embodiment of the color cathode ray tube according to the present invention.

FIG. 6 is a schematic section for explaining a construction of an electron gun to be used in a color cathode ray tube according to the present invention. Reference numerals 31 and 32 designate the apertures of the third grid electrode 13 to be passed by the side electron beams. The same reference numerals as those of the foregoing embodiments correspond to the identical portions in the construction.

In the foregoing individual embodiments, the S dimension has been described as being a dimension in the main lens portion. However, FIG. 6 shows an embodiment in which the S dimension of the triple-pole portion, including the cathodes of the electron gun, is larger than the S dimension of the main lens portion.

In FIG. 6, the three electron beams BR, BG and BB emitted in parallel with a large S dimension from the cathodes 10 enter the third grid electrode 13 through the first grid electrode 11 and the second grid electrode 12.

In the incident apertures of the third grid electrode 13, the apertures 31 and 32 to be passed by the two side electron beams BR and BB are offset by ΔS outwards in the in-line array direction so that the two side electron beams BR and BB to pass through the third grid electrode 13 are deflected in directions to approach the center electron beam BG asymptotically.

The individual electron beams which pass through the third grid electrode 13 then pass through the fourth grid electrode 14 and enter the fifth grid electrode 15 so that they are converged and accelerated by the main lens, which is established between the fifth grid electrode 15 and the sixth grid electrode 16.

Here, the two side electron beams BR and BB pass inwardly of the in-line direction by ΔS' so that the S dimension may be substantially reduced at the aforementioned main lens.

Incidentally, in FIG. 6, the two side electron beams BR and BB are offset by the third grid electrode 13, but may also be offset by the fourth grid electrode 14 to correct the orbit at two stages. In this modification, it is possible to adjust the angle at which the two side electron beams BR and BB enter the main lens.

In the individual embodiments thus far described, the main lens portion has its aperture flattened such that the semicircular arcs around the two side electron beam orbits are joined by parallel straight lines into an elliptical shape. The present invention can be likewise embodied by a structure in which two semi-elliptical arcs are joined in place of the semicircular arcs by two parallel straight lines. Similar effects can also be attained by joining arcs having larger diameters than those of the aforementioned semicircular or semi-elliptical arcs ares with two parallel straight lines.

Here will be specific examples of dimensions of the portions in the vicinity of the main lens in case the electron guns thus far described are applied to a so-called "21 inch type color cathode ray tube" having a neck portion having a diameter of 29 mm.

In one example, the aperture dimensions of the fifth grid electrode 15 and the sixth grid electrode 16 are H=19.4 mm, V=10.4 mm and S=4.5 mm (hence R=5.2 mm); the dimensions of the individual internal electrodes 15' and 16' have the vertical aperture diameters (i.e., a half of the longer diameters of the central elliptical aperture) V5 and V6 of V5=4.4 mm and V6=4.4 mm, horizontal aperture diameters (i.e., a half of the shorter diameter of the central elliptical aperture) A5 and A6 of A5=1.8 mm and A6=1.8 mm, horizontal aperture, diameters (i.e., a half of the shorter diameter of the two side elliptical apertures) B5 and B6 of B5=2.2 mm and B6=2.2 mm, and the sizes D5 and D6 of regression from the confronting end faces of the two electrodes of D5=5.0 mm and D6=5.0 mm.

A color cathode ray tube using an electron gun having a main lens set with the above-specified dimensions improved the focusing characteristics by about 20% over the color cathode ray tube using an electron gun of the prior art.

Incidentally, in the individual embodiments thus far described, the description is directed exclusively to the fifth grid electrode, but can be similarly applied to the sixth grid electrode. In this sixth grid electrode, the foregoing reference numerals "15" and "15'" are replaced by the numerals "16" and "16'".

Here will be described embodiments equipped with deflection means given a small S dimension for correcting the orbits of the three electron beams, which are emitted in diverging directions from the electron guns toward the fluorescent faces of the electron guns, in the converging directions.

Figure 7:
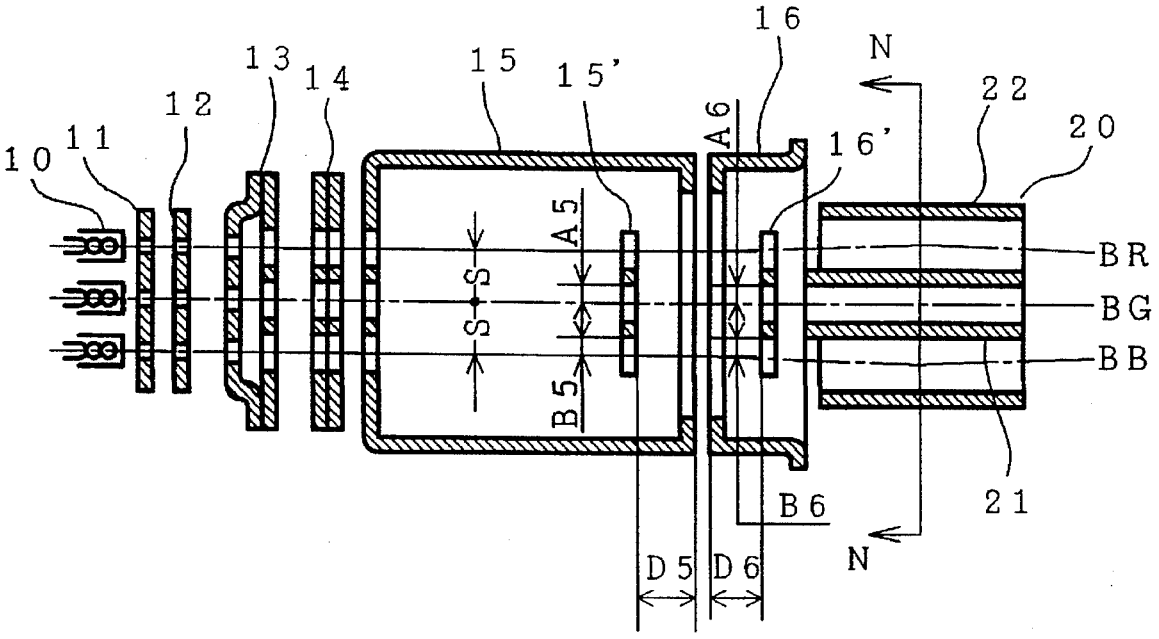
FIG. 7 is a schematic section for explaining a construction of an electron gun to be used in an embodiment of the color cathode ray tube according to the present invention.

FIG. 7 is a schematic section for explaining the construction of an electron gun to be used in a color cathode ray tube according to the present invention. Reference numerals 20, 21 and 22 designate a deflecting electrode, a rectangular electrode and flat electrodes, respectively, and the same reference numerals as those of the foregoing embodiments correspond to the identical portions.

In FIG. 7, the embodiment is characterized in that the deflecting electrode 20 is disposed at the side of the fluorescent face of the sixth grid electrode 16.

Figure 8:
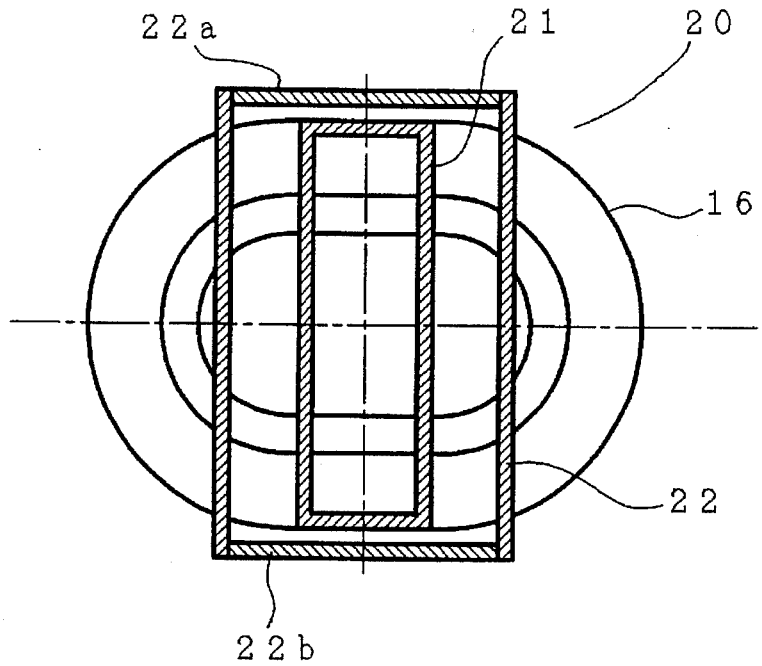
FIG. 8 is a front elevation of a sixth grid electrode, as taken along lines N—N of FIG. 7.

FIG. 8 is a front elevation showing the sixth grid electrode, as taken along lines N—N of FIG. 7. The deflecting electrode 20 is composed of the rectangular electrode 21 enclosing the center electron beam BG, and the parallel flat electrodes 22 enclosing the two side electron beams BR and BB. Incidentally, numerals 22*a* and 22*b* designate leg portions connecting the end portions of the paired parallel flat electrodes 22.

The same anode voltage as that of the sixth grid electrode 16 is applied to the rectangular electrode 21, and a voltage slightly lower than the anode voltage is applied to the parallel flat electrodes 22, so that the two side electron beams BR and BB may be converged upon the fluorescent face.

Figure 19:
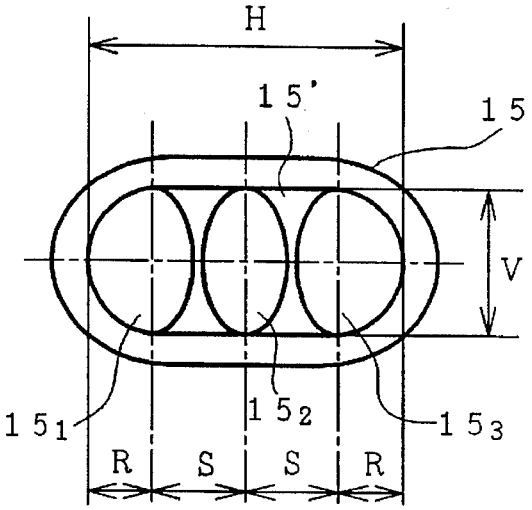
FIG. 19 (a) PRIOR ART
FIGS. 19(*a*) and 19(*b*) are front elevations showing the fifth grid electrode, as taken along lines M—M of FIG. 18.
Figure 19:
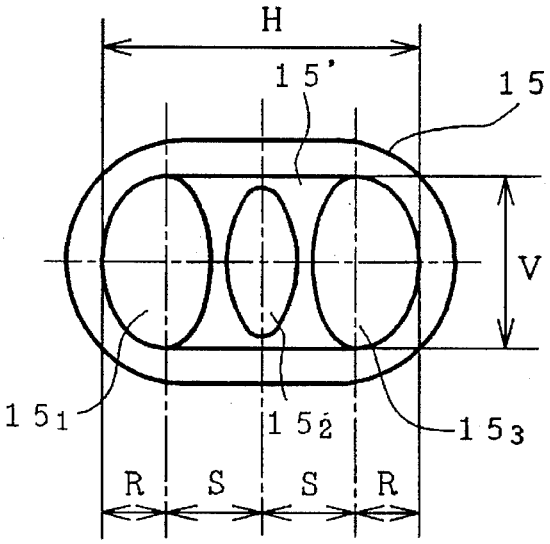
FIG. 19 (b) PRIOR ART
Figure 20:
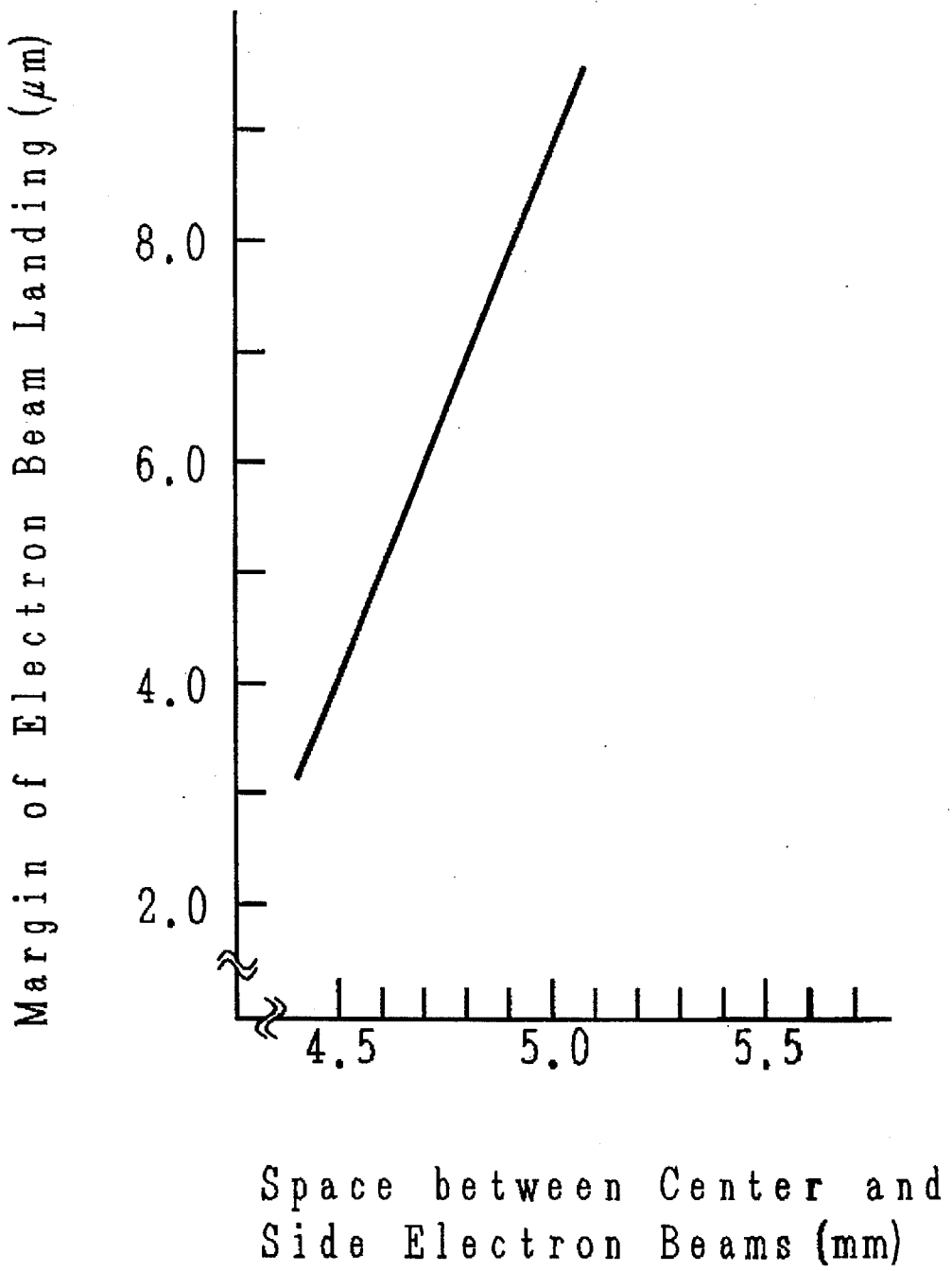
FIG. 20 PRIOR ART
FIG. 20 is an explanatory diagram of a relation between an S size and purity.
Figure 21:
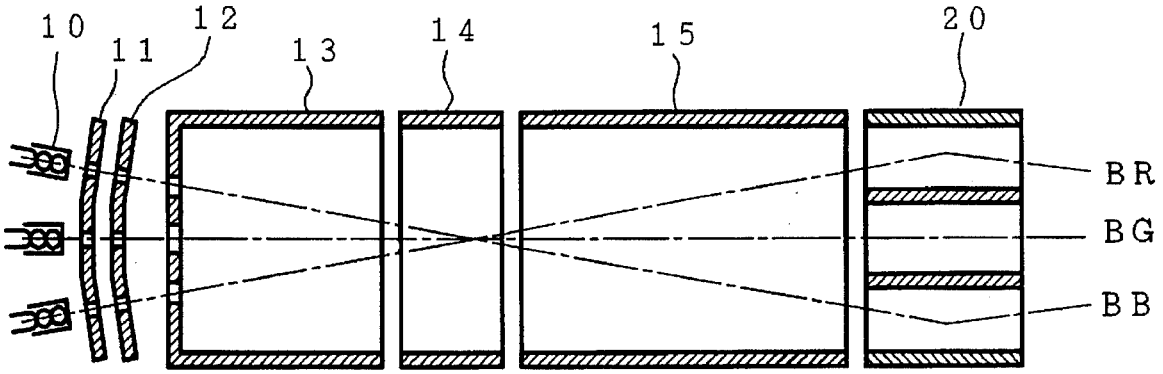
FIG. 21 PRIOR ART
FIG. 21 is a schematic section for explaining a schematic structure of an electron gun for a color cathode ray tube of the prior art, in which three electron beams are intersected by a single cylindrical main lens portion to constitute a large-aperture lens.

As shown in FIG. 7, the electron gun for the color cathode ray tube of the present embodiment is set such that the S dimension of the side beams BR and BB from the center beam BG of the three electron beams is reduced at the portion of the main lens formed between the fifth grid electrode 15 and the sixth grid electrode 16, as shown with the aforementioned aperture shape in FIG. 19(*b*), so that it can suppress spherical aberration and astigmatism.

Here, if the two side electron beams BR and BB are caused to pass through the portion of the main lens having a small S dimension and are converged toward the fluorescent face, their angle of incidence is reduced too much, as described above, so that it is difficult to get them to land on correct positions of the fluorescent face.

In the present embodiment, therefore, the fifth grid electrode 15 and the sixth grid electrode 16 constituting the main lens are equipped therein with the internal electrodes 15' and 16' so that the two side electron beams BR and BB may have their orbits corrected to enlarge the S dimension after they have passed through the main lens.

As a result, the two side electron beams BR and BB are diverged apart from the center electron beam BG. The side electron beams BR and BB thus diverged have their orbits corrected through the deflecting electrode 20 toward the center electron beam BG so that they are converged upon the fluorescent face.

Incidentally, in case the triple-pole unit having a large S dimension is to be applied to the present invention, the two side electron beams have to be deflected toward the center beam before they come into the main lens, so as to reduce the S dimension of the main lens. The following embodiment is directed to a construction of the electron gun, in which the S dimension is reduced in the aforementioned triple-pole unit.

Figure 9:
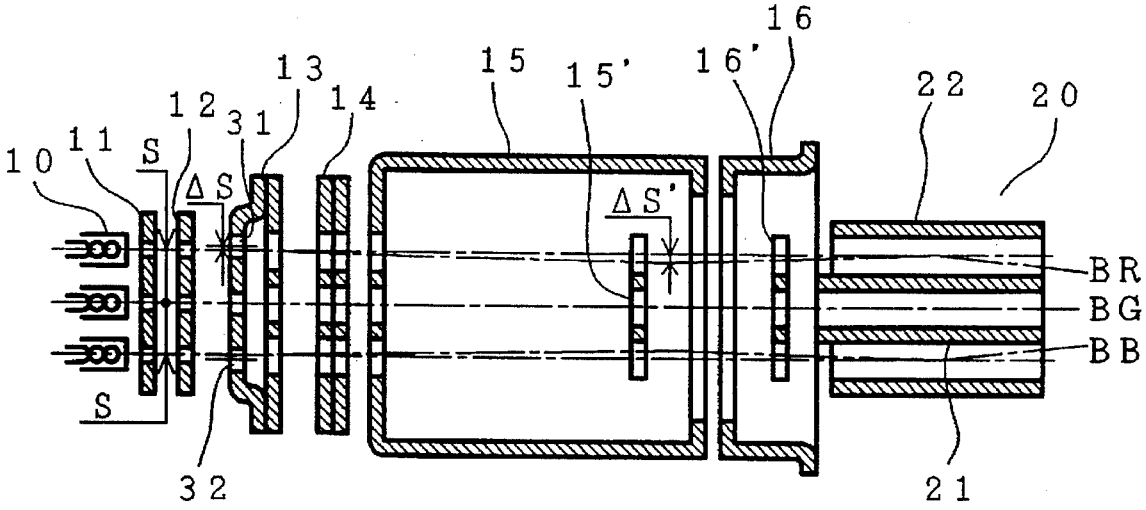
FIG. 9 is a schematic section for explaining a construction of an electron gun to be used in an embodiment of the color cathode ray tube according to the present invention.

FIG. 9 is a schematic section for explaining the construction of an electron gun to be used in a color cathode ray tube according to the present invention. The same reference numerals as those of FIG. 7 correspond to identical portions in FIG. 9.

In FIG. 9, the three electron beams BR, BG and BB emitted in parallel with the large gap of the S dimension from the cathodes 10 are caused to pass through the first grid electrode 11 and the second grid electrode 12. Of the incident apertures of the third grid electrode 13, moreover, the apertures 31 and 32 to be passed by the two side electron beams BR and BB are displayed (or offset) outwards by ΔS. As a result, the two side electron beams BR and BB are deflected in the directions to approach the center electron beam BG asymptotically, as indicated by double-dotted lines in FIG. 9.

Next, the individual electron beams BR, BG and BB are caused to pass the fourth grid electrode 14 into the fifth grid electrode 15 and are subjected to converging and accelerating forces by the main lens which is formed between the fifth grid electrode 15 and the sixth grid electrode 16.

Here, the two side electron beams BR and BB pass the aforementioned main lens inward (toward the center electron beam BG) to an extent of ΔS' so as to reduce the S dimension. As a result, the three electron beams BR, BG and BB pass through the central portion of the main lens so that the main lens substantially acts as a lens having a large aperture.

Since the three electron beams BR, BG and BB which have passed through the main lens have their S dimension reduced at the main lens, they have their orbits corrected in the diverging directions by the aperture offsetting of the internal electrode 16' of the sixth grid electrode 16 and are corrected again in the converging directions by the deflecting electrode 20.

Incidentally, in the embodiment of FIG. 9, the two side electron beams BR and BB have their orbits corrected by the aperture offsetting of the third grid electrode 13, but may have orbits corrected in two stages by additionally offsetting them at the fourth grid electrode 14. According to this construction, it is possible to adjust the angles at which the two side electron beams BR and BB come into the main lens.

Here will be described embodiments in which the construction for suppressing astigmatism is further embodied.

If, in the electron gun having the construction shown in FIG. 7, the dimension D5 of regression of the internal electrode 15' in the fifth grid electrode 15 from its aperture end portion at the side of the sixth grid electrode 16 is reduced, the two side electron beams BR and BB will be deflected outwardly because their inward deflecting actions become weaker.

If, on the contrary, the size D6 of regression of the internal electrode 16' in the sixth grid electrode 16 from its aperture end portion at the side of the fifth grid electrode 15 is reduced, the two side electron beams BR and BB will be deflected inwardly by the strengthened inward deflecting actions.

In order to deflect the two side electron beams BR and BB outwardly, therefore, it is necessary to make the regression dimension D6 larger than the aforementioned regression dimension D5.

On the other hand, this relation of D5<D6 is effective to make the electron beam converging actions stronger in the horizontal direction and weaker in the vertical direction, to cause such an astigmatism as to elongate the electron beams vertically.

Figure 10:
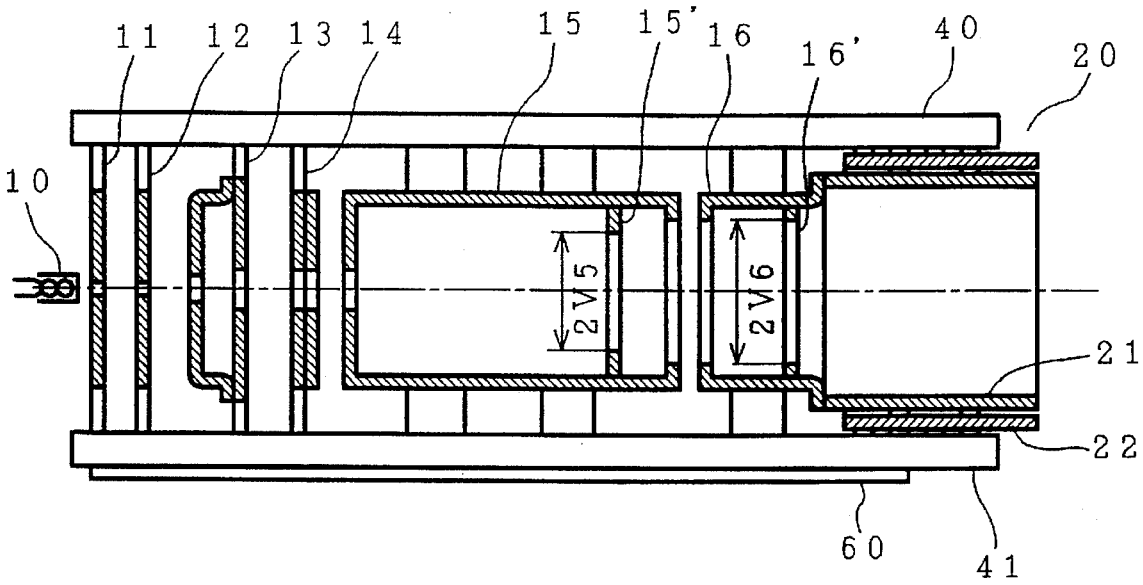
FIG. 10 is a schematic section for explaining an embodiment of the present invention embodying a construction for correcting an astigmatism, as taken in the in-line array direction of electron beams.

FIG. 10 is a schematic section, as taken in the in-line array direction of the electron beams, for explaining an embodiment of the present invention embodying a construction for correcting astigmatism. The same reference numerals as those of FIG. 7 correspond to the identical portions in FIG. 10.

In FIG. 10, the astigmatisms of the individual electron beams BR, BG and BB can be suppressed by making the vertical aperture diameters 2V5 and 2V6 of the internal electrodes 15' and 16' in the fifth grid electrode 15 and the sixth grid electrode 16 such that the aperture diameter 2V5 of the fifth grid electrode 15 is smaller (i.e., 2V5<2V6).

Such suppressions can be achieved from the relation of 2V5<2V6 because the vertical converging force in the fifth grid electrode 15 is strengthened, whereas the vertical diverging force of the sixth grid electrode 16 is weakened.

Figure 11:
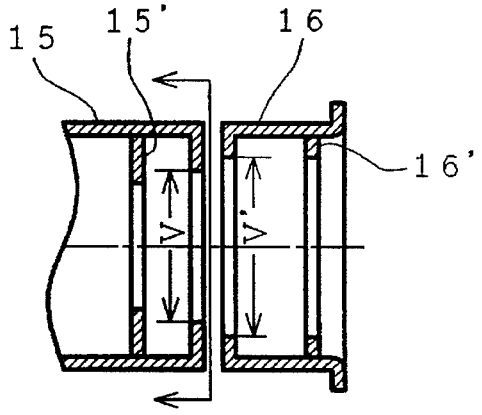
FIGS. 11(*a*) and 11(*b*) are explanatory diagrams of the present invention embodying the construction for correcting the astigmatism.
Figure 11:
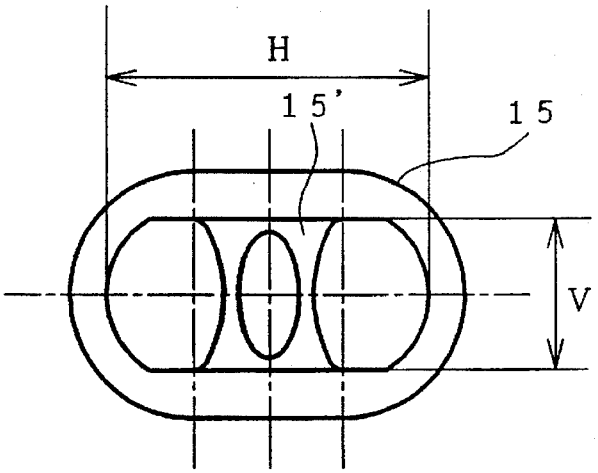

In FIGS. 11(*a*) and 11(*b*) for explaining an embodiment of the present invention embodying the construction for correcting astigmatism, FIG. 11(*a*) is a schematic section taken in the in-line array direction of the electron beams, and FIG. 11(*b*) is a front elevation showing the fifth grid electrode, as taken in the direction of arrows of FIG. 11(*a*). Incidentally, the same reference numerals as those FIG. 7 correspond to the identical portions in FIGS. 11(*a*) and 11(*b*).

In FIGS. 11(*a*) and 11(*b*), of the fifth grid electrode 15 and the sixth grid electrode 16 constituting the main lens, the vertical diameter V at the aperture end of the fifth grid electrode 16 confronting the sixth grid electrode to be supplied with the higher voltage is made slightly smaller than the vertical aperture diameter V' of the sixth grid electrode 16, as shown in FIG. 11(*a*), so that the individual electron beams BR, BG and BB can have their astigmatisms suppressed.

This suppression can be achieved by the actions similar to those obtained from the aforementioned relation of 2V5<2V6, and the internal electrodes 15' and 16' can be omitted depending upon the set dimensions.

Incidentally, the aperture of the fifth grid electrode 15 in this case is preferably shaped, as shown in FIG. 11(*b*), such that the arcs near the two side electron beams BR and BB are not reduced, but are narrowed in the vertical aperture diameter V.

Figure 12:
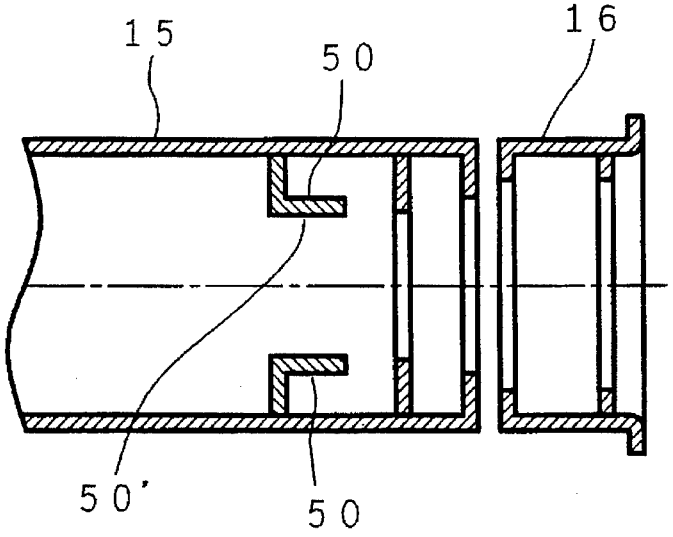
FIG. 12 is a schematic section for explaining the present invention embodying a construction for correcting the astigmatism, as taken in the in-line array direction of electron the beams.

FIG. 12 is a schematic section, as taken in the in-line array direction of the electron beams, for explaining an embodiment of the present invention embodying a construction for correcting astigmatism. Reference numerals 50 and 50' designate correction electrodes and their flat faces, and the same reference numerals as those of FIG. 7 correspond to the identical portions in FIG. 12.

Of the fifth grid electrode 15 and the sixth grid electrode 13 constituting the main lens, as shown in FIG. 12, the correction electrodes 50 having the flat faces 50' in the horizontal direction (or the in-line array direction) are disposed to interpose the individual election beams BR, BG and BB and are disposed in the fifth grid electrode 15 confronting the sixth grid electrode 13 to be supplied with the higher voltage, so that the individual electron beams BR, BG and BE can have their astigmatisms suppressed.

This is because the correction electrodes 50 in the fifth grid electrode 15 act to depress the electron beams (or flatten them in the horizontal direction) so that the electron beams are focused in a generally circular shape upon the fluorescent face.

Incidentally, these correction electrodes 50 may be provided exclusively for the two side electron beams BR and BB or the center electron beam BG in accordance with the situations of the astigmatisms.

Figure 13:
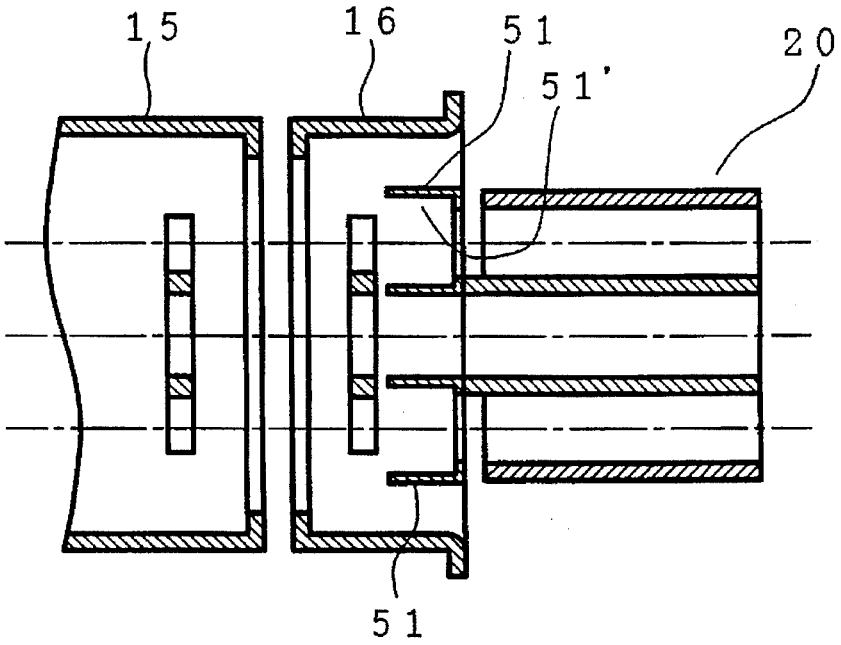
FIG. 13 is a schematic section showing an essential portion for explaining the present invention embodying construction for correcting the astigmatism, as taken in a direction perpendicular to the in-line array direction of the electron beams.

FIG. 13 is a schematic section showing an essential portion, as taken perpendicularly to the in-line array direction of the electron beams, for explaining an embodiment of the present invention embodying a construction for correcting astigmatism. Reference numerals 51 and 51' designate correction electrodes and their flat faces, and the same reference numerals as those of FIG. 7 correspond to the identical portions in FIG. 13.

Of the fifth grid electrode 15 and the sixth grid electrode 16 constituting the main lens, as shown in FIG. 13, the correction electrodes 51 having the flat faces 51' in the vertical direction are disposed to interpose the individual electron beams BR, BG and BB and are disposed in the fifth grid electrode 15 confronting the sixth grid electrode 16 to be supplied with the higher voltage, so that the individual electron beams BR, BG and BB can have their astigmatisms suppressed.

This is because the electron beams are attracted (or flattened in the horizontal directions) and focused into a generally circular shape upon the fluorescent face by replacing the correction electrodes 50 in the aforementioned fifth grid electrode 15 of FIG. 12 by the correction electrodes 51 in the sixth grid electrode 16.

Incidentally, these correction electrodes 51 have their sizes adjusted relative to those of the two side electron beams BR and BB or the center electron beam BG in accordance with the situation of the astigmatism.

Moreover, the method of deflecting the two side electron beams BR and BB outwards can be exemplified by the following ones in addition to the aforementioned method of adjusting the regression dimensions D5 and D6 of the internal electrodes 15' and 16', as shown in FIG. 7.

Figure 14:
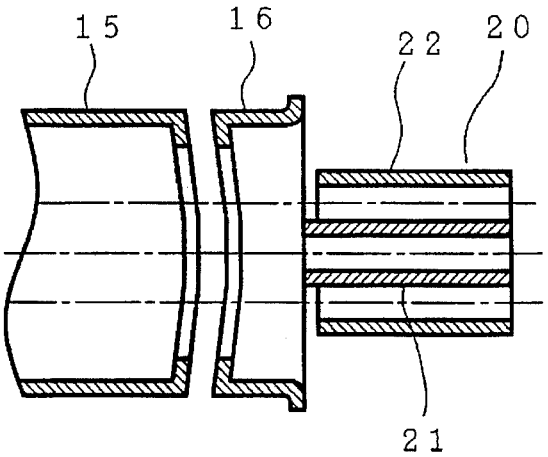
FIGS. 14(*a*) and 14(*b*) are schematic sections showing an essential portion for explaining the present invention further embodying a construction for deflecting the two side ones of the electron beams passing through a main lens.
Figure 14:
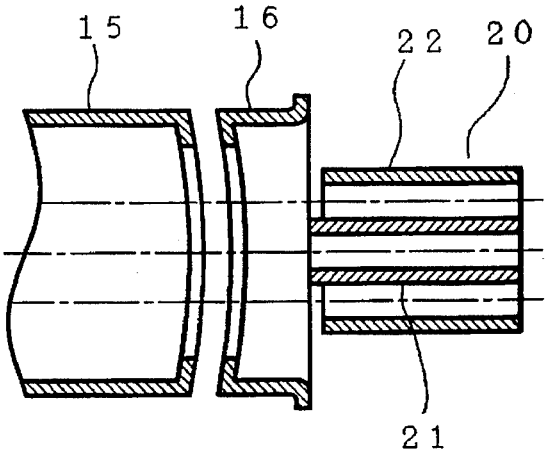

FIGS. 14(4) and 14(*b*) are schematic sections of an essential portion for explaining an embodiment of the present invention further embodying a construction of the two side ones of the electron beams passing through the main lens outwards. The same reference numerals as those of FIG. 7 correspond to the identical portions in FIGS. 14(*a*) and 14(*b*).

In FIGS. 14(*a*) and 14(*b*), as to the shape of the gap between the aperture end portions of the fifth grid electrode 15 and the sixth grid electrode 16 constituting the main lens, the side to be passed by the two side electron beams BR and BB is inclined toward the cathodes in FIG. 14(*a*), as viewed in the vertical direction (perpendicular to the in-line direction), so that the two side electron beams can be deflected outwards (to enlarge the S dimension), as compared with the center electron beam.

As shown in FIG. 14(*b*), moreover, the central portion between the aperture end portions of the fifth grid electrode 15 and the sixth grid electrode 16 constituting the main lens is formed into a gentle curve protruding toward the fluorescent face, so that the two side electron beams BR and BB can have their orbits corrected to enlarge the S dimension.

This is because the electric field of the main lens follows the shape of the gap between the aperture end portions of the fifth grid electrode 15 and the sixth grid electrode 16 so that the two side electron beams BR and BB have their orbits corrected in the direction to enlarge the S dimension. Depending upon this set dimension, moreover, the internal electrodes 15' and 16' can be dispensed with.

Figure 15:
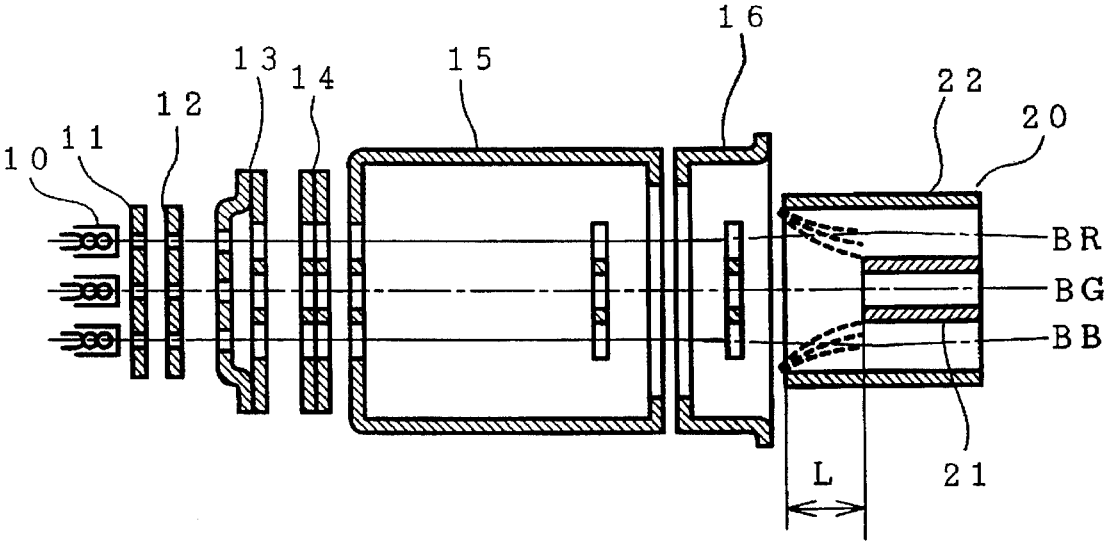
FIG. 15 is a schematic section showing an essential portion for explaining an embodiment of the present invention, in which the two side electron beams are more diverged outwards than the center electron beam.

Moreover, the construction shown in FIG. 15 may be adopted in case the two side electron beams BR and BB are to have their orbital divergences (in the direction apart from the center electron beam BG) further corrected when they pass through the main lens.

FIG. 15 is a schematic section of an essential portion for explaining an embodiment of the present invention, in which the two side electron beams are further diverged relative to the center electron beam.

In FIG. 15, the rectangular electrode 21 of the deflection electrode 20 has its axial length reduced more at the main lens side apart from the main lens by the dimension L than the flat electrode 22 so that the two side electron beams BR and BB can have their orbital divergences further corrected when they pass through the main lens.

This is because electric fields, as indicated by dotted lines, are established in the deflection electrode 20.

Incidentally, the construction of FIG. 15 is subject to a problem that the rectangular electrode 21 is shortened to enlarge its gap from the sixth grid electrode 16 so that the construction is liable to receive the influence of the external field noise. However, this problem can be avoided, for example, by shielding the aforementioned gap with the extended bent portion of the sides of the flat electrodes 22.

Here will be specified the preferred example of the dimensions near the main lens of the specific example, in which an electron gun according to the embodiments of a present invention was adopted in the 21 inch color cathode ray tube having the neck diameter of 29 mm.

In one example, the aperture dimensions of the fifth grid electrode 15 and the sixth grid electrode 16 were H=19.4 mm, V and V'=10.4 mm (as shown in FIG. 11), and S=4.5 mm. As to the dimensions (as shown in FIGS. 7 and 10) of the individual internal electrodes 15' and 16', the vertical aperture diameters (i.e., a half of the longer diameter of the central elliptical aperture) were V5=2,7 mm and V6=4.5 mm; the horizontal aperture diameters were A5 and A6=2.1 mm (i.e., a half of the shorter diameter of the central elliptical aperture), and B5 and B6=1.9 mm (i.e., a half of the shorter diameter of the two side elliptical apertures); the regression dimensions were D5=4.5 mm and D6=8.5 mm; the axial length of the deflection electrode 20 was 20 mm; and the rectangular electrode 21 was shortened by L=10 mm (as shown in FIG. 15).

Thanks to the dimensions and constructions thus far described, it is possible to provide a target electron gun for a color cathode ray tube, which has excellent focusing characteristics. Incidentally, it is needless to say that the foregoing dimensions merely provide examples and can be selected to obtain an optimum construction according to various conditions, such as the neck diameter of the color cathode ray tube.

Here will be described an assembly structure of the electron gun of a color cathode ray tube according to the present invention.

The individual electrodes constituting the electron gun are fixed as a whole by beading glasses 40 and 41, as shown in section in FIG. 10, presenting a section perpendicular to FIG. 7.

By means of an (not-shown) assembly jig, the deflection electrode 20 and the sixth grid electrode 16 are sequentially carried on a generally rod-shaped guide and inserted into a (not-shown) support of the cathodes 10, and the individual electrodes are set by a (not-shown) spacer.

Here, the deflection electrode 20 has its parallel flat electrodes 22 positioned inside of the width of the apertures of the fifth grid electrode 15 and the sixth grid electrode 16 constituting the main lens, so that they obstruct the assembling guide pin for threading the sixth grid electrode 16 and the downstream components. Therefore, only the leg portions 22*a* and 22*b* connecting the end portions of the flat electrodes 22 are fixed together with the rectangular electrode 21 and other electrodes by the beading glasses 40 and 41. After this, the flat electrodes 22 are fixed at a step of connecting the electrodes.

Thanks to the assembly structure described above, the apertures of the fifth grid electrode 15 and the sixth grid electrode 16 constituting the main lens can be directly guided by the assembly jig so that an electron gun having a high assembly accuracy can be manufactured.

Moreover, the drive of the deflection means according to the present invention is effected by providing a voltage dividing resistor 60 along the surface of either the beading glass 40 or 41 at the neck glass side and by dividing the anode voltage through the internal graphite film from the side of the funnel to supply the drive voltage.

If this voltage dividing resistor 60 is used, such a high drive voltage as could not be supplied due to the breakdown level from the socket at the neck end portion of the cathode ray tube can be supplied without any complicated structure of the funnel side or the internal graphite film.

Figure 16:
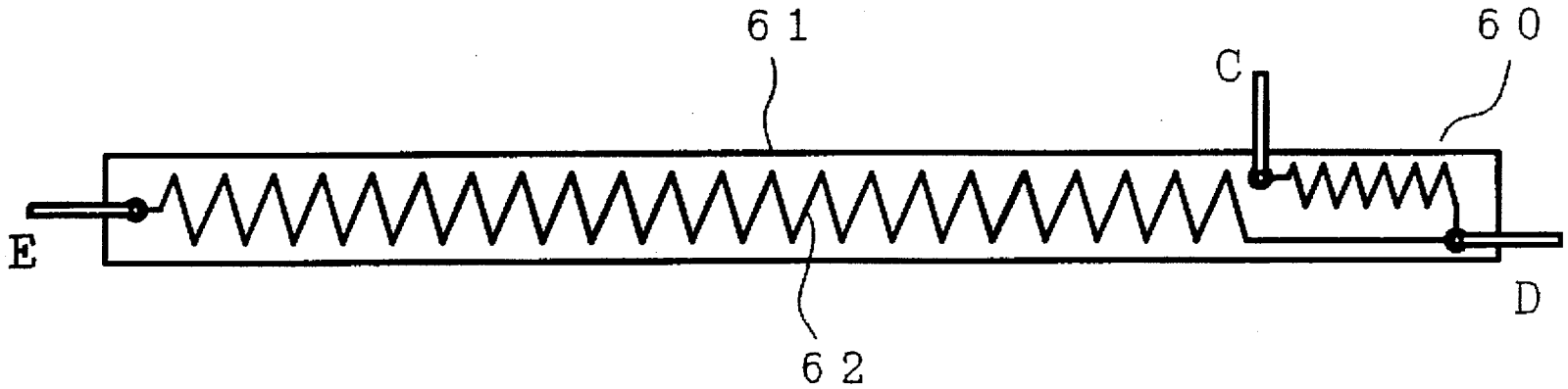
FIG. 16 is an explanatory diagram of a schematic construction of a voltage dividing resistor described with reference to FIG. 10.

FIG. 16 is a diagram for explaining the schematic construction of the voltage dividing resistor which has been described with reference to FIG. 10. The reference numeral 60 designates the voltage dividing resistor; numeral 61 designates an insulating substrate made of alumina; numeral 62 designates a highly resistive member; and letters C, D and E designate terminals.

In FIG. 16, the insulating substrate 61 is formed on its one side with the highly resistive member 62 having a total resistance of about 1,000 MΩ and is equipped with the individual terminals C, D and E.

Here the terminal C is supplied with the anode voltage; the terminal D is connected with the aforementioned flat electrodes 22; and the terminal E is grounded to the earth through an (not-shown) adjustable resistor which is disposed outside of the tube.

Although the foregoing description is directed to the method of concentrating the electron beams on the screen by electrostatic deflection means, the present invention can naturally be embodied by deflection means using a magnetic field.

In the foregoing embodiments, moreover, the two side electron beams are diverged in such a direction that the main lens has its S dimension enlarged. Even with such a construction, however, in which the individual beams are given generally parallel orbits downstream of the main lens and are condensed on the fluorescent face by deflection means interposed between the main lens and the fluorescent face, the effect of the present invention to enlarge the main lens aperture can be achieved without causing problems involving purity deterioration and an enlarged length of the electron guns.

Even with such a construction, moreover, in which the two side electron beams are slightly deflected toward the center electron beam by the main lens so that they are highly deflected, causing then to concentrate on the fluorescent face due to the aforementioned deflection means, the affects of the present invention can be achieved if the amount of deflection at the main lens is relatively small.

Figure 17:
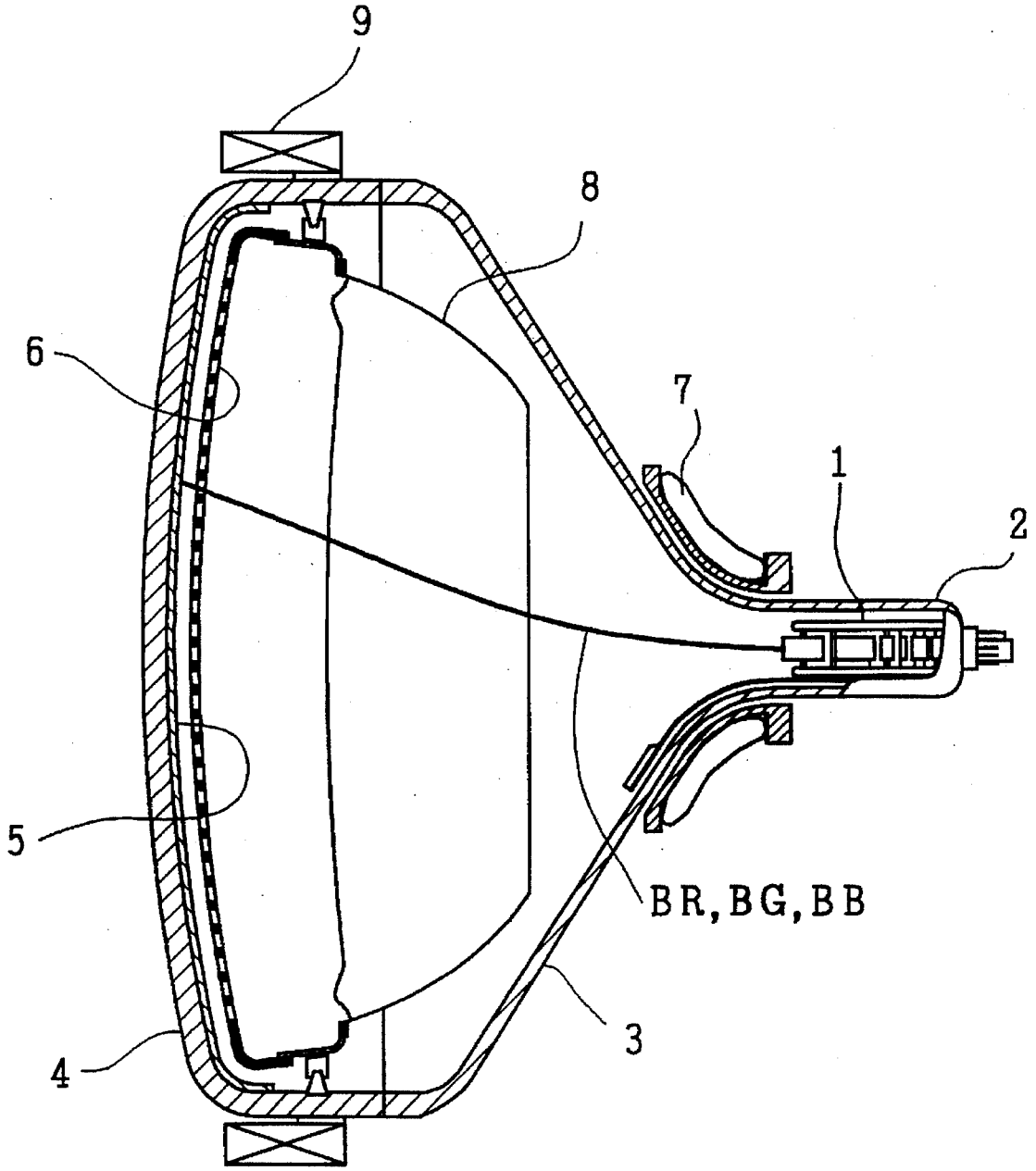
FIG. 17 is a schematic section for explaining one example of the entire structure of the color cathode ray tube according to the present invention.

FIG. 17 is a schematic section for explaining one example of the entire structure of the color cathode ray tube according to the present invention. Reference numeral 1 designates electron guns for emitting three electron beams BR, BG and BB horizontally (in the in-line direction); numeral 2 designates a neck portion for accommodating the electron guns; numeral 3 designates a funnel portion; numeral 4 designates a panel portion; numeral 5 designates a color fluorescent layer; numeral 6 designates a shadow mask; numeral 7 designates a deflection yoke; numeral 8 designates a magnetic shield for shielding the influence of external magnetism such as the earth magnetism; and numeral 9 designates a correction coil.

In FIG. 17, this color cathode ray tube has its vacuum enclosure formed of the neck portion 2, the funnel portion 3 and the panel portion 4, and the three electron beams BR, BG and BB emitted from the electron guns 1 accommodated in the neck portion 2 are deflected horizontally and vertically by the deflection yoke 7 mounted around the funnel portion 3 to impinge on the individual fluorescent elements composing the color fluorescent layer 5 after their colors have been selected by the shadow mask 6.

The correction coil 9 disposed around the panel portion 4 establishes a magnetic field having an equal magnitude, but an opposite direction to those of the vector of the primary component of an axial external magnetism, so that the electron beams BR, BG and BB having passed through the shadow mask 6 may not have their orbits deflected by that external magnetism.

Incidentally, the direction and magnitude of the external magnetic field are detected by a not-shown magnetic sensor disposed in the vicinity of the color cathode ray tube, so that the desired magnetic field is established by controlling the direction and magnitude of the electric current to be applied to the aforementioned correction coil, by the detection outputs of the magnetic sensor.

In the embodiments thus far described, the electron guns of the color cathode ray tube are exemplified by having U-BPF (i.e., Uni-Bi-Potential-Focusing) type multistage lenses. However, the present invention can be likewise applied even to other BPF (i.e., Bi-Potential-Focusing) or UPF (i.e., Uni-Potential-Focusing) type electron guns having different constructions.

Moreover, the correction coil, disposed in a color cathode ray tube to which is applied the present invention, is disposed in the example of FIG. 17 around the panel portion to buck any axial magnetic field. However, the correction should not be limited thereto, but can be exemplified by a correction coil disposed in another location of the color cathode ray tube for the magnetic field in another direction (perpendicular to the axis, horizontal or vertical) or by a plurality of those correction coils combined with a coil for bucking the external magnetic field to deflect the orbits of the electron beams.

Moreover, the aforementioned external magnetic field correcting means need not always be disposed in a color cathode ray tube of a small size having a high electron beam landing degree.

As has been described hereinbefore, according to the present invention, it is possible to provide a color cathode ray tube having excellent focusing characteristics, which is enabled to reduce the difference between the horizontal dimension and the vertical dimension at the confronting apertures of two electrodes constituting the main lens, thereby to give a main lens the larger aperture than that of the electron gun of the prior art and to suppress spherical aberration and astigmatism, by reducing the gap (or the S dimension) between the three electron beams of the electron gun in the common neck diameter to set a dimensional relation of R>S for the distance between the two side electron beam orbits and the inner circumference of the electrodes constituting the main lens.

In case, moreover, the S dimension is decreased, whereas the distance (or the Q dimension) between the shadow mask and the fluorescent face is increased to raise a problem in the displacement in the electron beams due to the external magnetic field, such as the earth magnetism, the focusing characteristics of the electron gun of the present invention can be sufficiently exploited by providing a correction coil for establishing a magnetic field to offset that external magnetic field. Still moreover, the reduction of the S dimension is also effective to improve the converging characteristics.

What is claimed is:

1. A color cathode ray tube comprising an electron gun having electron beam emitting means for emitting three electron beams including one center electron beam and two side electron beams generally disposed in parallel in one direction toward a fluorescent face; and a main lens for focusing said three electron beams upon said fluorescent face, wherein the main lens of said electron gun includes two electrodes arranged to confront each other with flattened apertures such that a diameter H taken in said one direction is larger than a diameter V taken perpendicularly to said one direction, wherein the orbits of the two side ones of said three electron beams passing through said main lens are spaced by a constant gap S from the orbit of said center electron beam, and wherein the relations of H=2(S+R) and R>S hold, in an aperture end portion of the two electrodes of the main lens arranged to confront each other, with the distance between the orbits of said two side electron beams and the inner circumference, as taken in said one direction, of said electrodes constituting said main lens being designated as R.

2. A color cathode ray tube according to claim 1, wherein the relation of V>2R holds between the diameter V of said electrodes constituting said main lens, as taken perpendicularly to said one direction, and a distance R from said side electron beam orbits to the inner circumference, as taken in said one direction, of the electrodes constituting said main lens.

3. A color cathode ray tube according to claim 1, wherein the relations of 2R+0.2 mm>V>2R−0.2 mm hold between the diameter V of said electrodes constituting said main lens, as taken perpendicularly to said one direction, and a distance R from said side electron beam orbits to the inner circumference, as taken in said one direction, of the electrodes constituting said main lens.

4. A color cathode ray tube comprising an electron gun having electron beam emitting means for emitting three electron beams including one center electron beam and two side electron beams which are disposed generally in parallel in one direction toward a fluorescent face; and a main lens for focusing said three electron beams upon said fluorescent face, wherein the main lens of said electron gun includes two electrodes arranged to confront each other with flattened apertures such that a diameter H taken in said one direction is larger than a diameter V taken perpendicularly to said one direction, wherein the orbits of the two side ones of said three electron beams passing through said main lens are spaced by a constant gap S from the orbit of said center electron beam, wherein the relations of H=2(S+R) and R>S hold, in an aperture end portion of the two electrodes of the main lens arranged to confront each other, with the distance between the orbits of said two side electron beams and the inner circumference, as taken in said one direction, of said electrodes constituting said main lens being designated as R, and further comprising deflection means interposed between said main lens and said fluorescent face for converging said two side electron beams and said center electron beam upon said fluorescent face.

5. A color cathode ray tube comprising an electron gun having electron beam emitting means for emitting three electron beams including one center electron beam and two side electron beams generally disposed in parallel in one direction towards fluorescent face; and a main lens for focusing said three electron beams upon said fluorescent face, wherein the main lens of said electron gun includes two electrodes arranged to confront each other with flattened apertures such that a diameter H taken in said one direction is larger than a diameter V taken perpendicularly to said one direction, wherein the orbits of the two side ones of said three electron beams passing through said main lens are spaced by a constant gap S from the orbit of said center electron beam and extend in parallel or diverging directions toward said fluorescent face with respect to the said center electron beam orbit, wherein the relations of H=2(S+R) and R>S hold, in an aperture end portion of the two electrodes of the main lens arranged to confront each other, with the distance between the orbits of said two side electron beams and the inner circumference, as taken in said one direction, of said electrodes constituting said main lens being designated as R, and further comprising deflection means interposed between said main lens and said fluorescent face for converging said two side electron beams and said center electron beam upon said fluorescent face.

6. A color cathode ray tube according to claim 1, 2, 3, 4 or 5, further comprising an internal electrode disposed in at least one of said two electrodes constituting the main lens of said electron gun and formed with an aperture having a dimensional relation for allowing said center electron beam to pass therethrough in which a diameter in said one direction is smaller than a diameter perpendicular to said one direction.

7. A color cathode ray tube according to claim 4 or 5, wherein said deflection means disposed between the main lens of said electron gun and said fluorescent face employs electrostatic deflection.

8. A color cathode ray tube according to claim 7, wherein said deflection means includes:

a rectangular electrode formed into a rectangular section having a longer axis perpendicular to said one direction for allowing said center electron beam to pass therethrough, and supplied with an anode voltage; and a pair of parallel flat electrodes enclosing said rectangular electrode and supplied with a voltage which is slightly lower than said anode voltage so as to allow said two side electron beams to pass therethrough.

9. A color cathode ray tube according to claim 1, 2, 3, 4 or 5, further comprising a correction coil for establishing a magnetic field to buck an external magnetic field acting upon said electron beams.

* * * * *